US009712936B2

(12) United States Patent
Peters

(10) Patent No.: US 9,712,936 B2
(45) Date of Patent: Jul. 18, 2017

(54) CODING HIGHER-ORDER AMBISONIC AUDIO DATA WITH MOTION STABILIZATION

(71) Applicant: QUALCOMM Incorporated, San Diego, CA (US)

(72) Inventor: Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/864,588

(22) Filed: Sep. 24, 2015

(65) Prior Publication Data

US 2016/0227340 A1 Aug. 4, 2016

Related U.S. Application Data

(60) Provisional application No. 62/111,641, filed on Feb. 3, 2015, provisional application No. 62/111,642, filed on Feb. 3, 2015.

(51) Int. Cl.
*H04R 3/00* (2006.01)
*H04S 3/00* (2006.01)
(Continued)

(52) U.S. Cl.
CPC ..... *H04S 3/008* (2013.01); *G10L 21/02* (2013.01); *G10L 2021/02166* (2013.01);
(Continued)

(58) Field of Classification Search
CPC ..... H04S 7/303; H04S 5/005; H04S 2400/11; H04S 2400/15; H04S 2420/13
See application file for complete search history.

(56) References Cited

U.S. PATENT DOCUMENTS 6,021,206 A * 2/2000 McGrath ..... H04S 3/004 381/310
2004/0247134 A1* 12/2004 Miller, III ..... H04S 3/002 381/19

(Continued)

FOREIGN PATENT DOCUMENTS

WO 2013083875 A1 6/2013
WO 2014147029 A1 9/2014

OTHER PUBLICATIONS

International Search Report and Written Opinion from International Application No. PCT/US2016/013048 ISA/EPO, dated Mar. 31, 2016, 12 pp.

(Continued)

*Primary Examiner* — Disler Paul
(74) *Attorney, Agent, or Firm* — Schumaker & Sieffert, P.A.

(57) ABSTRACT

In general, techniques and devices are described for motion compensation. An example a device configured to compensate motion. The device includes a memory configured to store audio data associated with a three-dimensional (3D) soundfield and one or more processors. The one or more processors are configured to receive motion information indicating one or more movements associated with a capture of one or more audio objects of a three-dimensional (3D) soundfield by a microphone array, and to adjust virtual positioning information associated with one or more microphones of a microphone array to compensate one or more movements associated with a capture of one or more audio objects of the 3D soundfield by the microphone array. The one or more processors may also be configured to generate a motion-compensated bitstream based on the adjusted virtual positioning information.

30 Claims, 15 Drawing Sheets

(51) Int. Cl.

| | |
|---|---|
| ***G10L 21/02*** | (2013.01) |
| *H04S 7/00* | (2006.01) |
| *H04S 5/00* | (2006.01) |
| *G10L 21/0216* | (2013.01) |

(52) U.S. Cl.
CPC .... *H04R 2201/401* (2013.01); *H04R 2430/21* (2013.01); *H04S 5/005* (2013.01); *H04S 7/303* (2013.01); *H04S 2400/11* (2013.01); *H04S 2400/15* (2013.01); *H04S 2420/11* (2013.01)

(56) References Cited

U.S. PATENT DOCUMENTS

| | | | | |
|---|---|---|---|---|
| 2010/0128892 | A1 | 5/2010 | Chen et al. | |
| 2012/0183156 | A1* | 7/2012 | Schlessinger | G06F 3/165 381/111 |
| 2013/0301835 | A1 | 11/2013 | Briand et al. | |
| 2013/0315402 | A1* | 11/2013 | Visser | G10L 19/00 381/18 |
| 2013/0317830 | A1* | 11/2013 | Visser | G10L 19/00 704/500 |
| 2014/0086416 | A1 | 3/2014 | Sen | |
| 2014/0233762 | A1 | 8/2014 | Vilkamo et al. | |
| 2014/0270248 | A1* | 9/2014 | Ivanov | H04R 3/005 381/92 |
| 2014/0355766 | A1 | 12/2014 | Morrell et al. | |
| 2015/0036848 | A1* | 2/2015 | Donaldson | H04S 7/303 381/303 |

OTHER PUBLICATIONS

ITU-T H.265, Series H: Audiovisual and Multimedia Systems, Infrastructure of audiovisual services—Coding of moving video, Advanced video coding for generic audiovisual services, The International Telecommunication Union. Apr. 2013, 317 pp.

ITU-T H.265, Series H: Audiovisual and Multimedia Systems, Infrastructure of audiovisual services—Coding of moving video, Advanced video coding for generic audiovisual services, The International Telecommunication Union. Apr. 2015, 634 pp.

"Call for Proposals for 3D Audio," ISO/IEC JTC1/SC29/WG11/N13411, Jan. 2013, 20 pp.

Zotter, "Analysis and Synthesis of Sound-Radiation with Spherical Arrays," Institute of Electronic Music and Acoustics, Sep. 2009, 192 pp.

Zotter, et al. "Spatial transformations for the enhancement of Ambisonic recordings," Jan. 2014, 6 pp.

Sen, et al., "RM1-HOA Working Draft Text ", MPEG Meeting; Jan. 13-17, 2014; San Jose; (Motion Picture Expert Group or ISO/IEC JTC1/SC29/WG11),,No. m31827, Jan. 11, 2014, XP030060280, 83 pp.

Poletti, "Three-Dimensional Surround Sound Systems Based on Spherical Harmonics," J. Audio Eng. Soc., vol. 53, No. 11, Nov. 2005, pp. 1004-1025.

Response to Written Opinion dated Mar. 31, 2016, from International Application No. PCT/US2016/013048, filed on Sep. 14, 2016, 16 pp.

International Preliminary Report on Patentability from International Application No. PCT/US2016/013048, dated Jan. 25, 2017, 18 pages.

* cited by examiner 5
300
377
375
2

5
300
377
375
4

5
300
377
375
3
6

5
300
377
375
1

5
300
377
375
6

CODING HIGHER-ORDER AMBISONIC AUDIO DATA WITH MOTION STABILIZATION

This application claims the benefit of:

U.S. Provisional Application No. 62/111,641, titled "CODING HIGHER-ORDER AMBISONIC AUDIO DATA WITH MOTION STABILIZATION," filed 3 Feb. 2015; and U.S. Provisional Application No. 62/111,642, titled "CODING HIGHER-ORDER AMBISONIC AUDIO DATA WITH MOTION STABILIZATION," filed 3 Feb. 2015, the entire contents of each of which are incorporated herein by reference.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for coding of higher-order ambisonics audio data. Higher-order ambisonics audio data may comprise at least one higher-order ambisonic (HOA) coefficient corresponding to a spherical harmonic basis function having an order greater than one.

In one aspect, this disclosure is directed to a method of motion compensation. The method includes receiving, by a device configured to compensate motion, motion information indicating one or more movements associated with a capture of one or more audio objects of a three-dimensional (3D) soundfield by a microphone array. The method further includes adjusting, by the device configured to compensate motion, virtual positioning information associated with one or more microphones of a microphone array to compensate the one or more movements associated with the capture of the one or more audio objects of the 3D soundfield by the microphone array. The method may further include generating, by the device configured to compensate motion, a motion-compensated bitstream based on the adjusted virtual positioning information.

In another aspect, this disclosure is directed to a device configured to compensate motion. The device includes a memory configured to store audio data associated with a three-dimensional (3D) soundfield and one or more processors. The one or more processors are configured to receive motion information indicating one or more movements associated with a capture of one or more audio objects of a three-dimensional (3D) soundfield by a microphone array, and to adjust virtual positioning information associated with one or more microphones of a microphone array to compensate one or more movements associated with a capture of one or more audio objects of the 3D soundfield by the microphone array. The one or more processors may also be configured to generate a motion-compensated bitstream based on the adjusted virtual positioning information.

In another aspect, this disclosure is directed to a device configured to compensate motion. The device includes means for storing audio data associated with a three-dimensional (3D) soundfield, means for receiving motion information indicating one or more movements associated with a capture of one or more audio objects of the 3D soundfield by a microphone array, and means for adjusting virtual positioning information associated with one or more microphones of a microphone array to compensate the one or more movements associated with the capture of the one or more audio objects of the 3D soundfield by the microphone array. The device may also include means for generating a motion-compensated bitstream based on the adjusted virtual positioning information.

In another aspect, this disclosure is directed to a non-transitory computer-readable storage medium encoded with instructions. The instructions, when executed, cause one or more processors of a computing device for compensating motion to receive motion information indicating one or more movements associated with a capture of one or more audio objects of the 3D soundfield by a microphone array, to adjust virtual positioning information associated with one or more microphones of a microphone array to compensate the one or more movements associated with the capture of one or more audio objects of the 3D soundfield by the microphone array, and to generate a motion-compensated bitstream based on the adjusted virtual positioning information.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
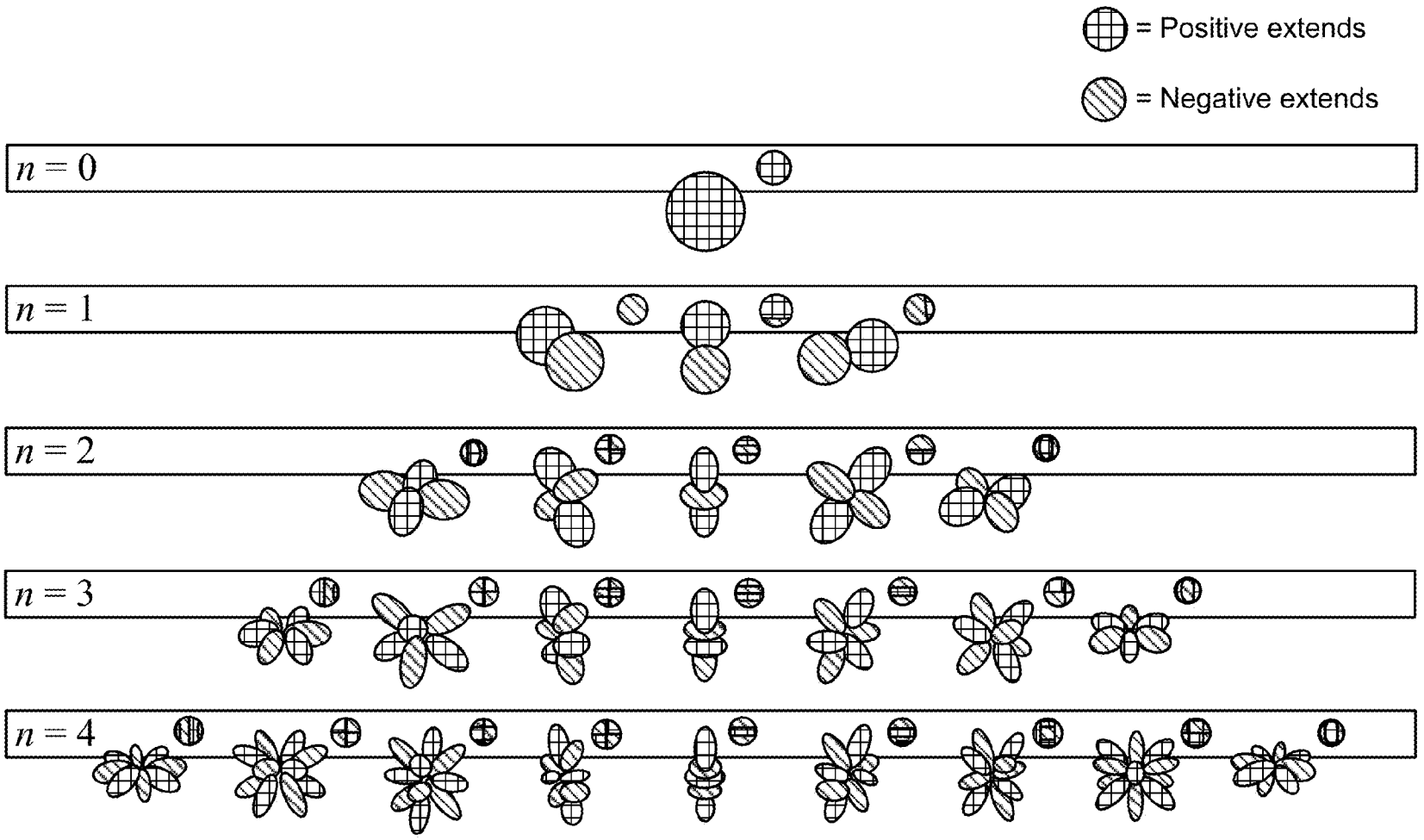
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \phi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^m(\theta_s,\phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \phi_r\}$. The remaining figures are described below in the context of object-based and SHC-based audio coding.

Figure 2:
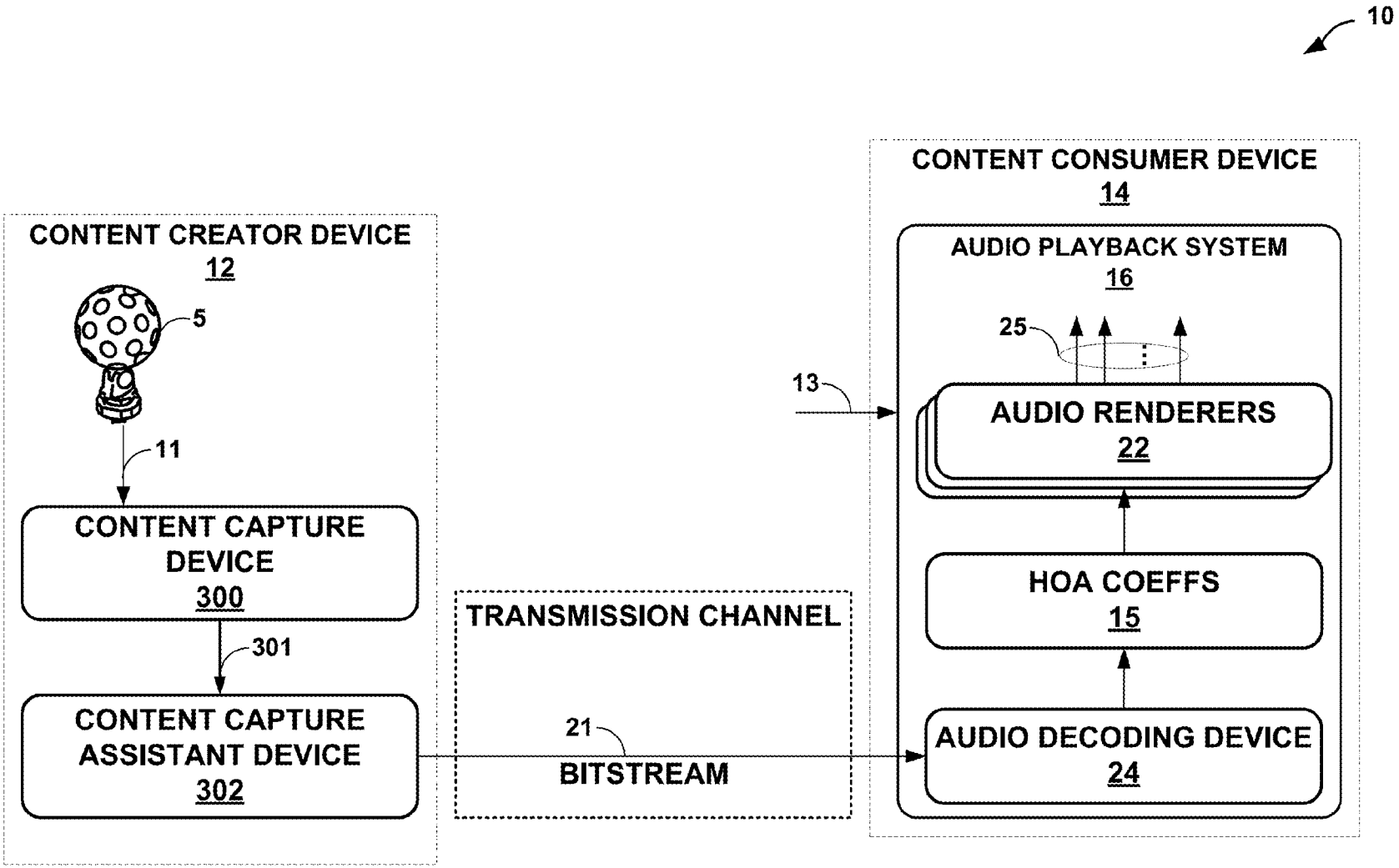
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes a content capture device 300 and a content capture assistant device 302. The content capture device 300 may be configured to interface or otherwise communicate with a microphone 5. The microphone 5 may represent an Eigenmike® or other type of 3D audio microphone capable of capturing and representing the soundfield as HOA coefficients 11. The content capture device 300 may, in some examples, include an integrated microphone 5 that is integrated into the housing of the content capture device 300. In some examples, the content capture device 300 may interface wirelessly or via a wired connection with the microphone 5. Various combinations of the content capture device and the microphone are described in more detail below.

The content capture device 300 may include a camera, a ruggedized camera (which may include a protective case and components suitable for live recording during sports and other rugged activities), a cellular phone, a so-called "smart phone," a tablet computer, a desktop computer, a workstation, or any other device capable of interfacing with the microphone 5 to capture the HOA coefficients 11 representative of the soundfield. The content capture device 300 may also be configured to interface or otherwise communicate with the content capture assistant device 302. The content capture assistant device 302 may include a cellular phone, a so-called "smart phone," a tablet computer, a desktop computer, a workstation, or any other device capable of interfacing with the content capture device 300.

The content capture device 300 may, in some examples, be configured to wirelessly communicate with the content capture assistant device 302. In some examples, the content capture device 300 may communicate, via one or both of a wireless connection or a wired connection, communicate with the content capture assistant device 302. Via the connection between the content capture device 300 and the content capture assistant device 302, the content capture device 300 may provide content in various forms of content 301. The content 301 may include one or more of video data, text data, image data, and audio data. When the content 301 includes video data, the video data may be in an uncompressed form or a compressed form. When the content includes image data, the image data may be in an uncompressed form or a compressed form. When the content includes audio data, the audio data may be in an uncompressed form or a compressed form.

The content capture assistant device 302 may represent a device configured to interface with the content capture device 300 to assist in capturing the content 301. The content capture assistant device 302 may, in some examples, execute an application (which may be referred to as an "app") configured to allow an operator of the content capture assistant device 302 to control the operation of the content capture device 300. The application may allow the operator to configure various settings of the content capture device 300, such as video recording settings, text settings, image capture settings, and audio recording settings. The application may also allow the operator to initiate capture of the content 301, stop capture of the content 301 or both initiate and stop the capture of the content 301.

The content capture assistant device 302 may also assist in various ways with the processing of the content 301. In some examples, the content capture device 300 may leverage various aspects of the content capture assistant device 302 (in terms of hardware or software capabilities of the content capture assistant device 302). For example, the content capture assistant device 302 may include dedicated hardware configured to (or specialized software that when executed causes one or more processors to) perform psychoacoustic audio encoding (such as a unified speech and audio coder denoted as "USAC" set forth by the Motion Picture Experts Group (MPEG)). The content capture device 300 may not include the psychoacoustic audio encoder dedicated hardware or specialized software and instead provide audio aspects of the content 301 in a non-psychoacoustic-audio-coded form. The content capture assistant device 302 may assist in the capture of content 301 by, at least in part, performing psychoacoustic audio encoding with respect to the audio aspects of the content 301.

The content capture assistant device 302 may also assist in content capture by generating one or more bitstreams 21 based, at least in part, on the content 301. The bitstream 21 may represent a compressed version of the HOA coefficients 11 and any other different types of the content 301 (such as a compressed version of captured video data, image data, or text data). The content capture assistant device 302 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 15 from the bitstream 21, where the HOA coefficients 15 may be similar to the HOA coefficients 11 but differ due to lossy operations (e.g., quantization) and/or transmission via the transmission channel. The audio playback system 16 may, after decoding the bitstream 21 to obtain the HOA coefficients 15 and render the HOA coefficients 15 to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers may then playback the rendered loudspeaker feeds 25.

Figure 3A:
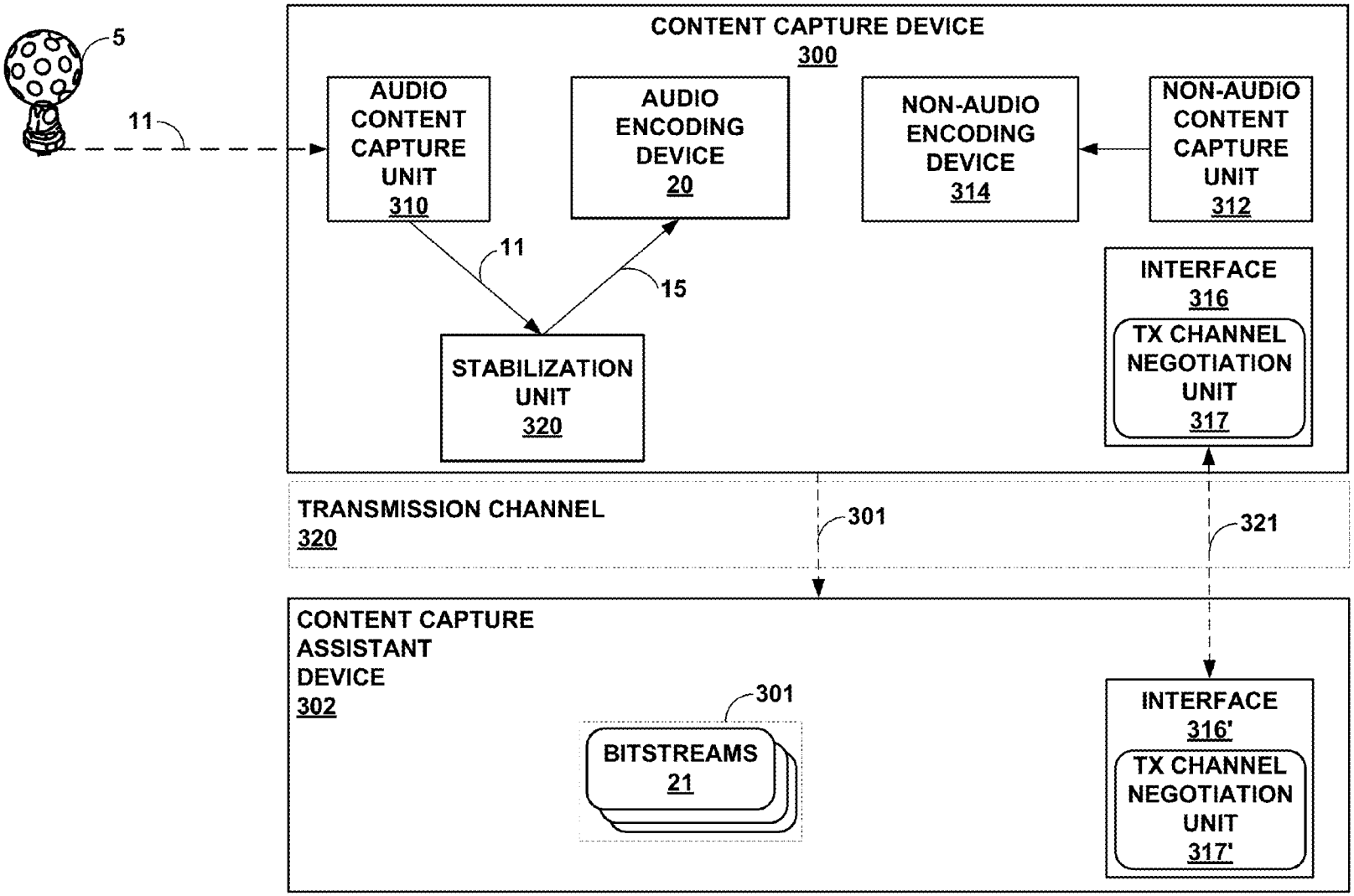
FIGS. 3A and 3B are block diagrams illustrating example implementations of a content capture device and a content capture assistant device according to aspects of this disclosure in more detail.
Figure 3B:
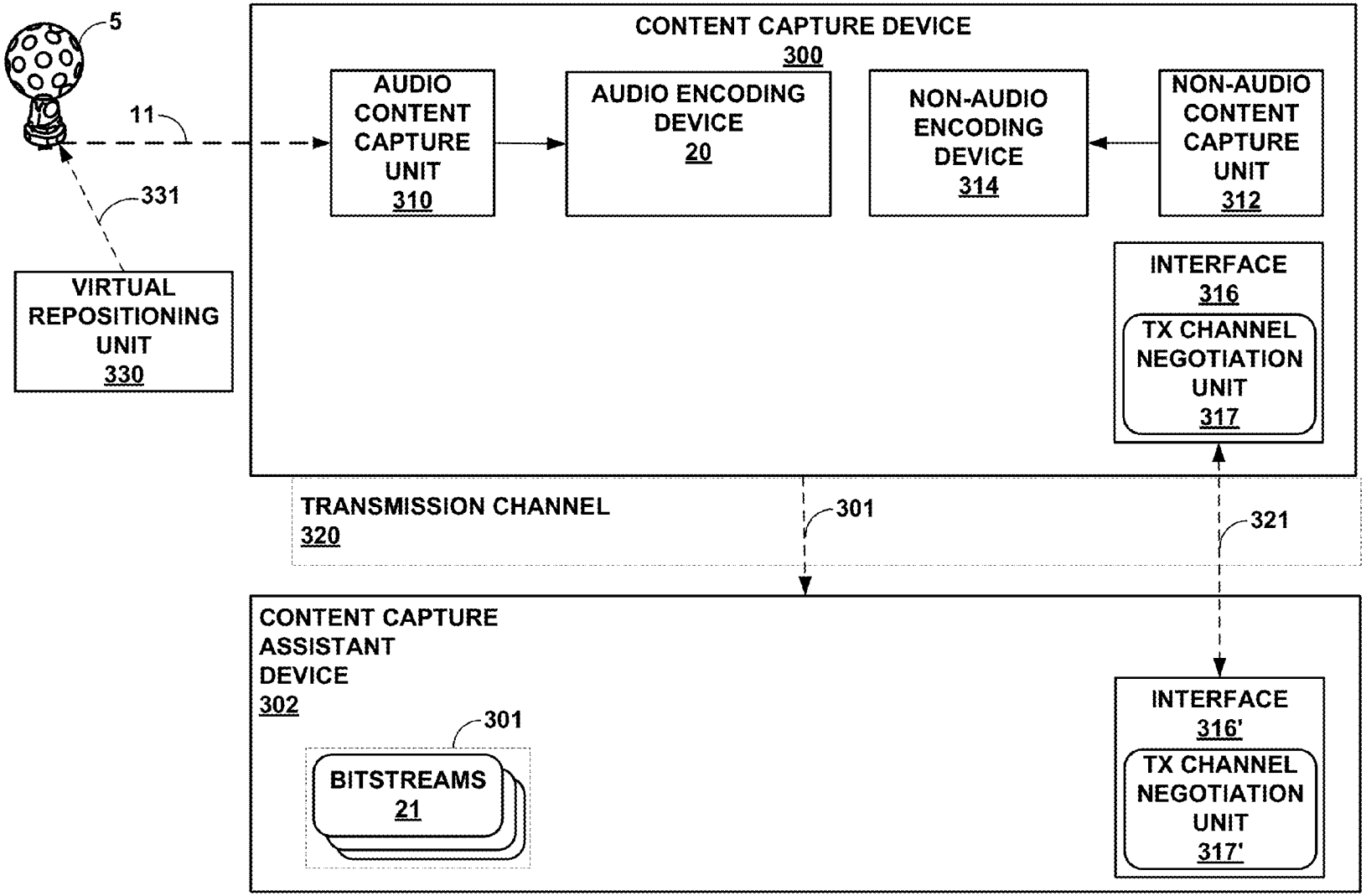

FIGS. 3A and 3B are block diagrams illustrating example implementations of the content capture device 300 and the content capture assistant device 302 in more detail. The example of FIG. 3A is generally directed to post-transcoding stabilization techniques of this disclosure. The content capture device 300 includes an audio content capture unit 310, an audio encoding device 20, a non-audio content capture unit 312, a non-audio encoding device 314, and interface unit 316 ("interface 316"). As shown, the content capture device 300 also includes a stabilization unit 320. The audio content capture unit 310 may represent a unit configured to interface with the microphone 5 and supply audio data received from the microphone 5 to the stabilization unit 320. The audio content capture unit 310 may provide the captured HOA coefficients 11 to the stabilization unit 320. Although the microphone 5 is described above as capturing the HOA coefficients 11 above, it will be appreciated that, in various implementations, other components of the content capture device (e.g., the audio content capture unit 310) may generate the HOA coefficients 11 using audio data provided by the microphone 5. For instance, the stabilization unit 320 may transcode the outputs of the microphone 5 into HOA coefficients using position information for each individual microphone included in the microphone array of the microphone 5.

In turn, the stabilization unit 320 may implement techniques of this disclosure to adjust the HOA coefficients 11 to compensate for particular motion information related to microphone 5. More specifically, the stabilization unit 320 may stabilize audio objects of a soundfield to mitigate or, in some cases, remove the effects caused by microphone jitter or other such movements associated with the microphone 5. In the example of FIG. 3A, the stabilization unit 320 may remediate jitter-indicating movements of the microphone 5 using data in the HOA domain (namely, the HOA coefficients 11).

Additionally, the stabilization unit 320 may receive the movement information for the microphone 5 from a device configured to sense motion information in multiple degrees of freedom, for example, three dimensions (3D) or six degrees of freedom, such as an accelerometer or compass that helps to track movement. In turn, the stabilization unit 320 may apply the 3D motion information to perform the motion stabilization techniques of this disclosure. In various examples, the microphone 5 may include a built-in accelerometer (e.g., positioned at the center of the spherical array of the individual microphones), or may be coupled to an external accelerometer (e.g., an accelerometer affixed to other components of the microphone 5). In one example, the accelerometer may be included in the stem or handle of the microphone 5. In general, the accelerometer may be positioned at any location that rotates along the same plane or along a substantially similar plane to the array of the microphone 5. More specifically, the stabilization unit 320 may perform the motion stabilization by applying inverse rotation to the HOA coefficients 11.

Stabilizing the soundfield by compensating for movements (e.g., that are indicative of jitter) may be more computationally efficient when implemented in the HOA domain (e.g., with respect to the HOA coefficients 11), as is the case in the implementation of FIG. 3A. Thus, in various scenarios, the solution illustrated in FIG. 3A may be more feasible than other alternatives. For example, the stabilization unit 320 may compensate movements (e.g., jitter) in the 3D soundfield captured by the microphone 5 without requiring the introduction of structural constraints and additions to the microphone 5 or the content capture device 300. Thus, the stabilization unit 320 may compensate movements, such as jitter, without potentially impeding the usability of the content capture device 300 and/or the microphone 5 with respect to capturing user-generated content and/or first person accounts.

In a specific example, the stabilization unit 320 may analyze the motion information associated with the microphone 5, and rotate the soundfield in an inverse manner to the recorded motion information. In some examples, the stabilization unit 320 may only compensate (or inversely rotate) certain movements of the microphone 5. For instance, the stabilization unit 320 may compensate only quick movements, jitters, or high-frequency movements, all of which are described as "micromovements" above. More specifically, in this example, the stabilization unit 320 may retain other (e.g., smoother, or more gradual) motion information recorded by the accelerometer, thereby maintaining the integrity of 3D audio generation.

In various examples, the stabilization unit 320 may implement the motion stabilization techniques of this disclosure by applying an effects matrix to the HOA coefficients 11. The stabilization unit 320 may generate the effects matrix using the motion information recorded for the microphone 5 by the accelerometer. More specifically, the stabilization unit 320 may generate the effects matrix such that the application of the effects matrix to a soundfield results in an inverse rotation of the soundfield, as compared to the motion information recorded by the accelerometer for the microphone 5. By applying the effects matrix, the stabilization unit 320 may add a mixing and/or a weighting to the HOA coefficients 11 generated by the audio content capture unit 310. In this example, the HOA coefficients 11 received by the stabilization unit 320 may represent "uncompensated" HOA coefficients. By applying the effects matrix to the uncompensated HOA coefficients 11, the stabilization unit 320 may generate the motion-compensated HOA coefficients 15. Further details of the effects matrix and the motion compensation processes of this disclosure are described below with respect to FIGS. 4A-4D.

The audio encoding device 20 may represent a unit configured to code the HOA coefficients 11 so as to reduce the size (in bits) of the HOA coefficients 11. The audio encoding device 20 may generate the bitstream 21, which is then passed to the content capture assistant device 302 for purposes of retransmission or storage. The audio encoding device 20 may generate the bitstream 21 to conform to known audio standards, such as the ISO/IEC JTC1/SC29/WG11 emerging standard entitled "RM1-HOA Working Draft Text," dated January 2014, and presented in San Jose, USA with document number ISO/IEC JTC1/SC29/WG11 MPEG2014/M31827.

The non-audio content capture unit 312 may represent a unit configured to capture all non-audio content, such as video data, image data or text data. It is assumed for purposes of illustration that the non-audio content capture unit 312 may capture non-audio content in the form of video data. The non-audio encoding device 314 may represent a unit configured to encode the video data. The non-audio encoding device 314 may generate a bitstream that conforms to a video coding standard. An example video coding standard is the High-Efficiency Video Coding (HEVC) standard, which was recently finalized by the Joint Collaboration Team on Video Coding (JCT-VC) of ITU-T Video Coding Experts Group (VCEG) and ISO/IEC Motion Picture Experts Group (MPEG). The latest HEVC specification, referred to as HEVC Version 1 hereinafter, is available from http://www.itu.int/rec/T-REC-H.265-201304-I. The non-audio encoding device 314 may generate a bitstream 21 representative of a compressed version of the video data.

The interface unit 316 represents a unit configured to interface with another device. The interface unit 316 may interface with the other device via a network, such as a wireless local area network (WLAN), a peer-to-peer network or a personal area network (PAN). An example of a WLAN is an IEEE 802.11g WLAN that conforms to the IEEE 802.11g wireless standard. An example of a PAN is a PAN that conforms to the Bluetooth™ set of specifications. The interface unit 316 may, in some examples, interface with the other device via a dedicated connection (e.g., a wire).

Given that the HOA coefficients 11 may describe the soundfield in three-dimensions (3D), the size of the uncompressed HOA coefficients 11 may be rather large. In a fourth-order representation of the soundfield, each sample of HOA coefficients 11 includes $(4+1)^2$ or 25 coefficients. Each of the coefficients is a 32-bit number. Each sample of the HOA coefficients 11 is therefore approximately 25×32 or 800 bits.

The content capture device 300 may invoke the interface 316 to interface via the transmission channel 321 with the content capture assistant device 302. Whether via PAN or WLAN, the transmission channel 321 may provide insufficient bandwidth to accommodate raw audio data in the form of uncompressed HOA coefficients 11, especially when the content capture device 300 is also attempting to provide the video data via the same transmission channel 321. While described with respect to a wireless transmission channel (which may represent a PAN or WLAN transmission channel), the techniques may also be utilized in wired settings. In wired settings, certain other limitations may arise, such as limits in data processing, caching and storage speeds. Moreover, storage sizes may limit how much data can be stored. As such, the techniques should not be limited to the examples of wireless transmission channels, but may also apply to wired settings. Moreover, the data processing, caching, storage speeds and storage size limitations may also arise in both wired and wireless settings. Accordingly, the techniques may apply in any combination of these settings with any combination of the limitations.

To allow for transmission of content 301 via the transmission channel 321, the content capture device 300 may first encode the HOA coefficients 11 and any accompanying non-audio data, such as the video data. To encode the HOA coefficients 11, the content capture device 300 may invoke the audio encoding device 20. The audio encoding device 20 may encode the HOA coefficients 11 to obtain the bitstream 21, providing the bitstream 21 as part of the content 301. The interface 316 may, when forming the transmission channel 321, invoke the transmission (TX) channel negotiation unit 317. The TX channel negotiation unit 317 may negotiate with the corresponding TX channel negotiation unit 317 of the interface 316 included within the content capture assistant device 302.

The TX channel negotiation unit 317 of the content capture device 300 and the corresponding TX channel negotiation unit 317' of the content capture assistant device 302 may then negotiate establishment of the transmission channel 321, selecting appropriate channels and configuring these channels to allow for data communications between interface 316 of the content capture device 300 and the corresponding interface 316' of the content capture assistant device 302. During the negotiation of the transmission channel 321, the TX channel negotiation unit 317 of the content capture device 300 may request information regarding various aspects of the content capture assistant device 302. The information may comprise information indicative of a storage capacity available at the content capture assistant device 302 for the storage of the content 301. The TX channel negotiation unit 317 of the content capture assistant device 302 may provide the information indicative of the storage capacity to the TX channel negotiation unit 317 of the content capture device 300.

FIG. 3B illustrates an example implementation that is generally directed to pre-transcoding stabilization techniques of this disclosure. In other words, the implementation of FIG. 3B is directed to motion compensation operation(s) on audio data at a pre-transcoding stage, i.e. audio data that is not in the HOA domain.

As shown in FIG. 3B, the virtual repositioning unit 330 may communicate the virtual repositioning data 331 to the microphone 5 to compensate movements, such as movements indicative of jitter. In turn, microphone 5 may apply the virtual repositioning data 331 to adjust the spatial information for audio objects captured by the individual microphones of the microphone 5, and propagate the virtual repositioning for future audio captures. Further details of the pre-transcoding stabilization techniques of FIG. 3B are described below with respect to FIG. 5.

Figure 4A:
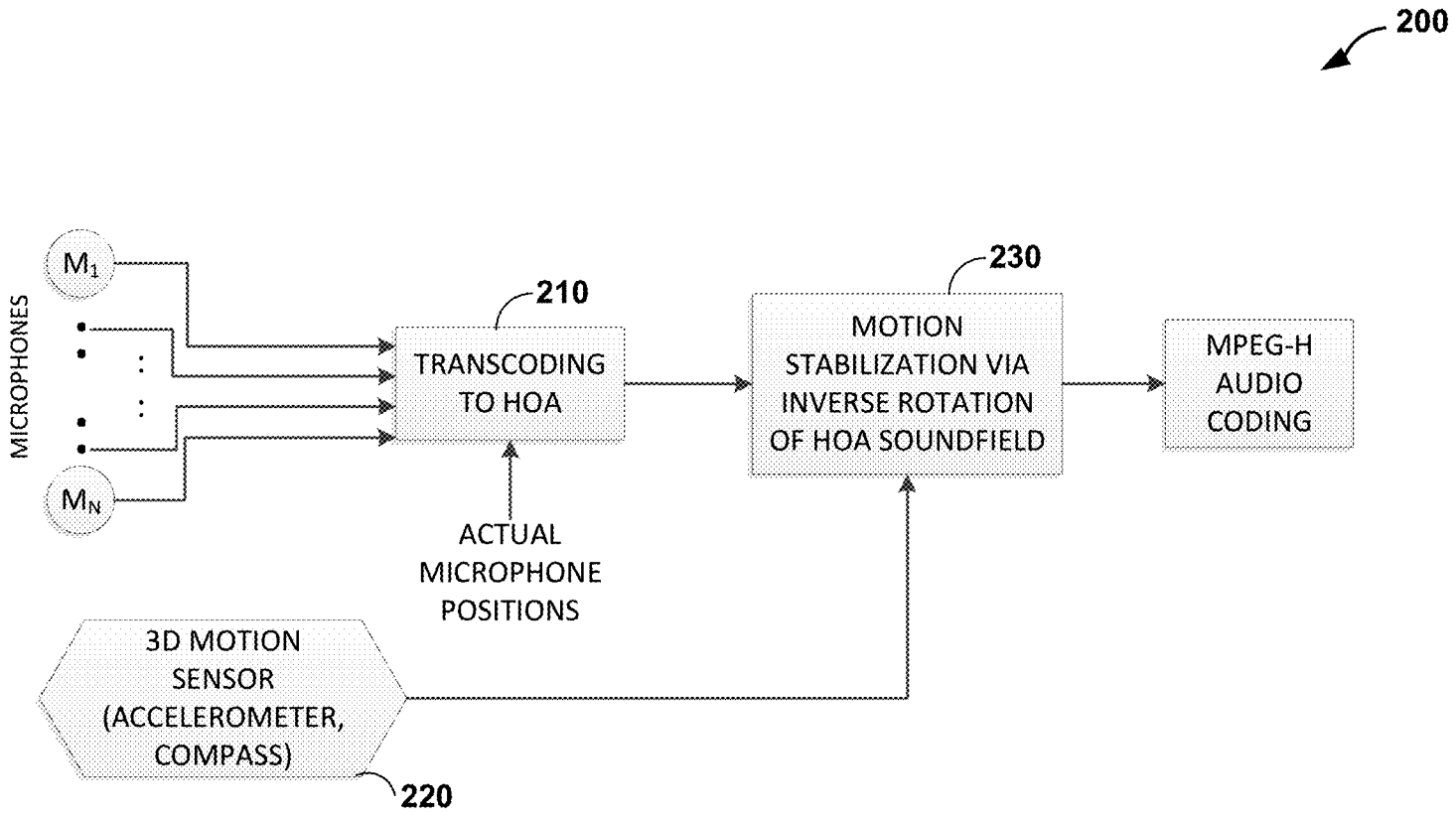
FIG. 4A is a flowchart illustrating exemplary operation of an audio encoding device in performing various aspects of the coding techniques described in this disclosure.

FIG. 4A is a flowchart illustrating exemplary operation of an audio encoding device in performing the coding techniques described in this disclosure. Although the process 200 may be performed by a variety of devices, for ease of discussion purposes only, the process 200 is described below as being performed by one or more components of the audio encoding device 20 of FIG. 3A. For instance, the stabilization unit 320 (and/or one or more components thereof, working individually or in various combinations) may implement the process 200 of FIG. 4A to stabilize audio objects of a soundfield to mitigate or, in some cases, remove the effects caused by microphone jitter or other such movements. FIG. 4A illustrates an implementation in which the stabilization unit 320 of FIG. 3A remediates movement issues in the HOA domain. As shown in the particular example of FIG. 4A, the stabilization unit 320 may transcode the microphone outputs into HOA coefficients using the actual positions of each individual microphone of 3D audio-enabled microphone array $M_1$ through $M_n$ (210). For instance, the actual position information for each individual microphone may reflect the movements (including jitter and/or so-called "micromovements") caused by the movement of the microphone array.

Additionally, according to the process 200 illustrated in FIG. 4A, the stabilization unit 320 may receive motion information for the microphones $M_1$ through $M_n$ from a device configured to sense motion information in 3D, such as an accelerometer or compass that helps to track movement (220). In turn, the stabilization unit 320 may use the received motion information to derive or otherwise determine movement information for each of the individual microphones $M_1$ through $M_n$. The stabilization unit 320 may apply the 3D motion information to perform the motion stabilization techniques of this disclosure (230). In various examples, the microphone may include a built-in accelerometer (e.g., positioned at the center of the spherical array of individual microphones $M_1$ through $M_n$), or may be coupled to an external accelerometer (e.g., an accelerometer affixed to other components of a camera/microphone setup). In one example, the accelerometer may be included in the stem or handle of the microphone. More specifically, the stabilization unit 320 may perform the motion stabilization by applying inverse rotation to an HOA domain-representation of the 3D soundfield captured by the array of individual microphones $M_1$ through $M_n$. The accelerometer may be positioned at any location that rotates along the same plane or along a substantially similar plane to the array of individual microphones $M_1$ through $M_n$. In implementations where the stabilization unit 320 has access to the positional relationship between the accelerometer and the array of individual microphones $M_1$ through $M_n$, the stabilization unit 320 may derive the motion information for the microphone array even if the accelerometer does not rotate along the same or a substantially similar plane as the microphone array. In this manner, the stabilization unit 320 may implement techniques of this disclosure to leverage data provided by the accelerometer in a variety of ways to determine the motion information of the microphone array, and in turn obtain movement information of each of the individual microphones $M_1$ through $M_n$.

Stabilizing the soundfield by compensating movements may be more computationally efficient when implemented in the HOA domain, as is the case in the example of FIG. 4A. Thus, in various scenarios, the solution of the process 200 may be more feasible than other alternatives. For example, by implementing the process 200 of FIG. 4A, the stabilization unit 320 may compensate movements in the soundfield without requiring the introduction of structural constraints and additions to a camera and/or microphone system. Thus, the stabilization unit 320 may compensate movements without potentially impeding the usability of the camera and/or microphone systems with respect to capturing user-generated content and/or first person accounts.

In a specific example, the stabilization unit 320 may analyze the received (220) motion information, and rotate the soundfield in an inverse manner to the captured motion (230). In some examples, the stabilization unit 320 may only compensate (or inversely rotate) certain movements received at the step 220. For instance, the stabilization unit 320 may compensate only quick movements, jitters, or high-frequency movements, all of which are described as "micromovements" above. More specifically, in this example, the audio encoding device 20 may retain other (e.g., smoother, or more gradual) motion information, thereby maintaining the integrity of 3D audio generation.

Figure 4B:
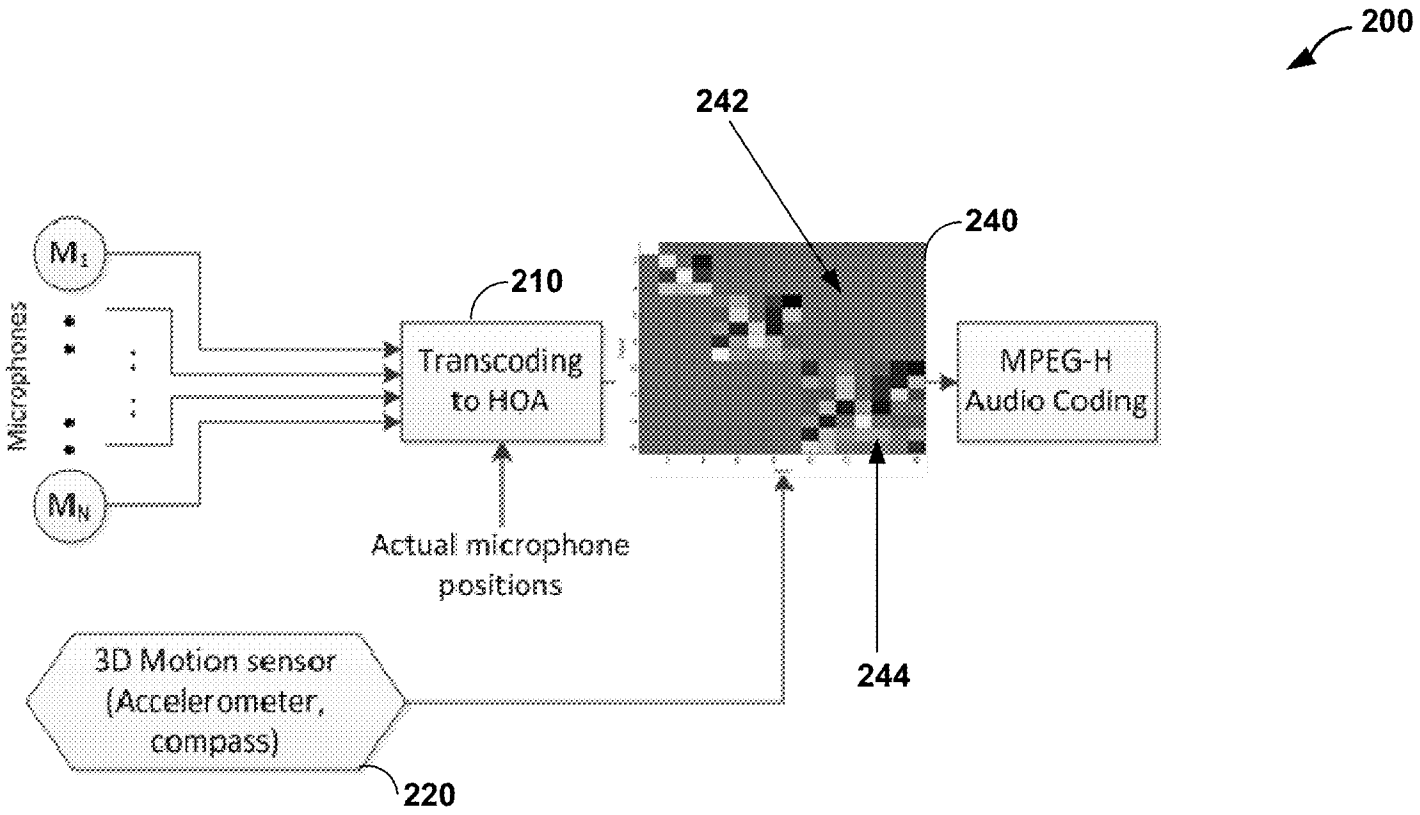
FIG. 4B is a flowchart illustrating an alternative representation of the process illustrated in FIG. 4A.

FIG. 4B is a flowchart illustrating an alternative representation of the process 200 of FIG. 4A. In the example of FIG. 4B, the motion stabilization is illustrated by way of an effects matrix 240. The audio encoding device 20 may generate the effects matrix 240 using the motion information received for the microphones $M_1$ through $M_n$ at the step 220. More specifically, the stabilization unit 320 may generate the effects matrix 240 such that the application of the effects matrix 240 to a soundfield results in an inverse rotation of the soundfield, as compared to the motion information received at the step 220. The effects matrix 240 includes a zero region 242, which is graphically distinguished from a significant region 244 in FIG. 4B. The zero region may represent matrix entries or cells that do not indicate any rotation to the uncompensated HOA coefficients to which the effects matrix 240 is applied. Conversely, the significant region 244 may represent matrix entries or cells that have a certain "weight" associated, and thus, represent some level of rotation to rotate the uncompensated HOA coefficients generated at the step 210. In applying the effects matrix 240, the stabilization unit 320 may add a mixing and/or a weighting to the uncompensated HOA coefficients generated at the step 210.

In the example of FIG. 4B, the significant region 244 forms less than fifty percent of the effects matrix 240, while the zero region 242 represents greater than fifty percent of the effects matrix 240. Thus, in the example of FIG. 4B, the stabilization unit 320 may perform the motion stabilization techniques of this disclosure to inversely rotate only a minority of the uncompensated HOA coefficients transcoded at the step 210. As illustrated in FIG. 4B, the stabilization unit 320 may perform motion compensation according to this disclosure in a computationally efficient manner, by targeting specific movements (e.g., micromovements that indicate jitter) received at the step 220, and compensating only the targeted movements, by applying the effects matrix 240.

Figure 4C:
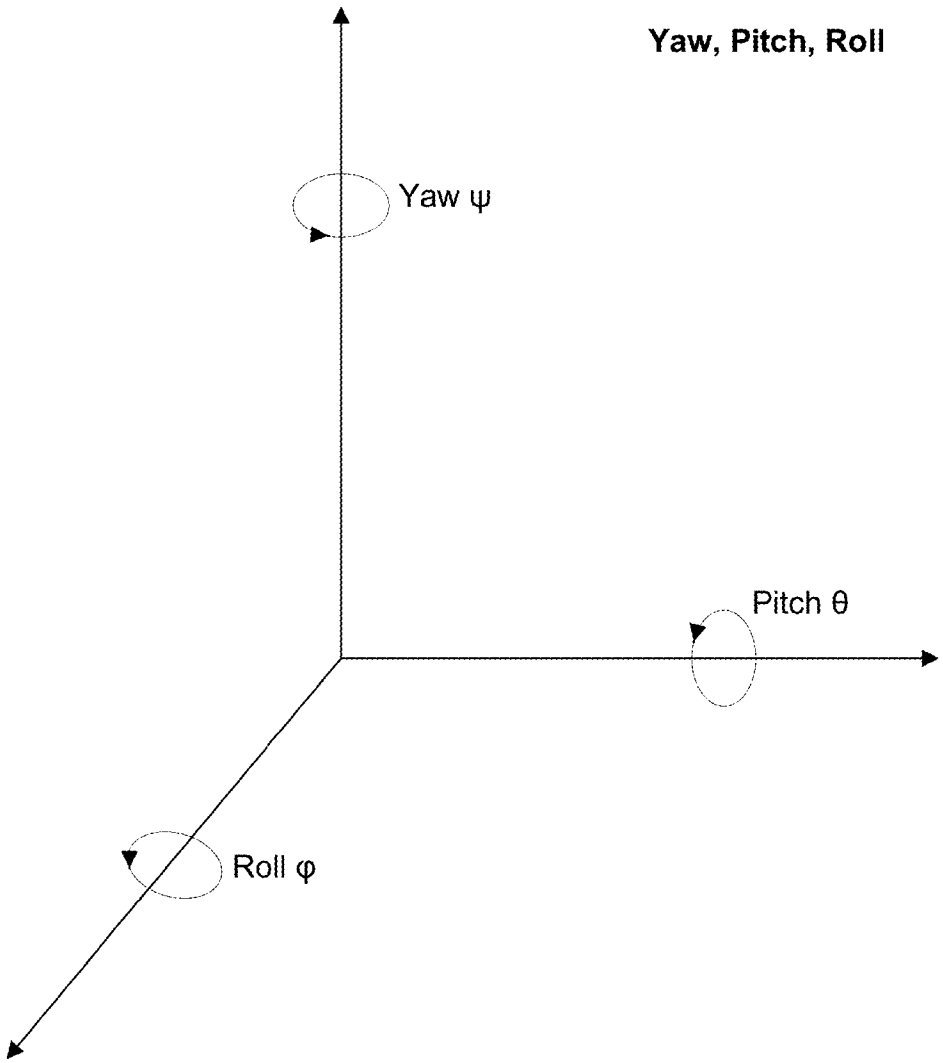
FIG. 4C is a conceptual diagram illustrating various angles that a stabilization unit may use in measuring 3D movement of audio objects of a soundfield, in accordance with one or more aspects of this disclosure.

FIG. 4C is a conceptual diagram illustrating various angles (i.e., rotations) that the stabilization unit 320 may use in measuring 3D movement of audio objects of a soundfield. A mathematical representation of a calculation of the effects matrix 240 illustrated in FIG. 4B is as follows:

$$R(\phi,\theta,\psi)=\underbrace{\begin{pmatrix}1&0&0\\0&\cos\phi&-\sin\phi\\0&\sin\phi&\cos\phi\end{pmatrix}}_{x-axis-rotation(roll)}\cdot\underbrace{\begin{pmatrix}\cos\theta&0&\sin\theta\\0&1&0\\-\sin\theta&0&\cos\theta\end{pmatrix}}_{y-axis-rotation(pitch)}\cdot\underbrace{\begin{pmatrix}\cos\psi&-\sin\psi&0\\\sin\psi&\cos\psi&0\\0&0&1\end{pmatrix}}_{z-axis-rotation(yaw)}.$$

In the equation above, the effects matrix 240 is represented by the expression R(ϕ, θ, ψ). In turn, ϕ represents the roll angle, θ represents the pitch angle, and ψ represents the yaw angle. In applying the effects matrix 240 to inversely rotate the uncompensated HOA coefficients, the audio encoding device 20 may apply one or more filters, such as a lowpass filter, a median filter, or a Kalman filter.

Various techniques to compute a rotation matrix in the HOA domain have been described e.g., by Zotter, "Analysis and Synthesis of Sound-Radiation with Spherical Arrays" or Kronlachner and Zotter, "Spatial transformations for the enhancement of Ambisonic recordings." One such technique is described herein. According to this example technique, the rotation matrix is computed in the spatial domain and converted into the HOA domain via a discrete spherical harmonic transform ("DSHT"). The transformation integral is sampled by a suitable distribution of sampling points in L directions $\Gamma=[\gamma_1, \ldots \gamma_L]^T$ with $L>=(N+1)^2$ directions.

The rotation matrix $M_{rot}$ in the HOA domain is computed based on the rotation kernel R(ϕ, θ, ψ) and the spherical harmonics up to the HOA order N for the directions F and R·Γ. The calculation of the rotation matrix $M_{rot}$ may be expressed as follows:

$$M\text{rot}=\text{DSHT}N\{Y(R(\phi,\theta,\psi)\cdot\Gamma)\}$$

$$M\text{rot}=Y^{\dagger}(\ )\cdot Y(R(\phi,\theta,\psi)\cdot\Gamma)$$

where $(\bullet)^{\dagger}$ denotes the Monrose-Penn pseudo inverse of (•).

Figure 4D:
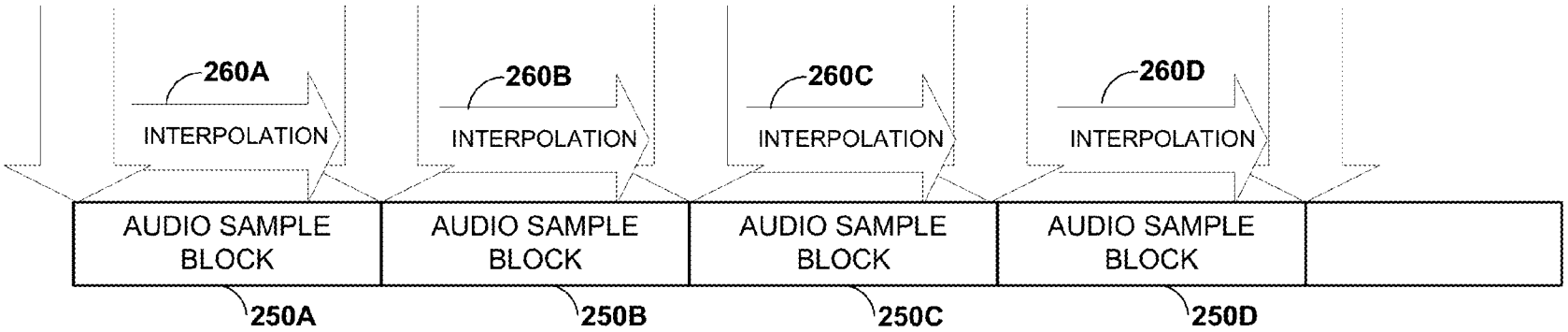
FIG. 4D is a conceptual diagram illustrating a refinement that a stabilization unit may implement with respect to the process of FIG. 4A for motion stabilization of audio objects in the HOA domain, in accordance with one or more aspects of this disclosure.

FIG. 4D is a conceptual diagram illustrating a refinement that the stabilization unit 320 may implement with respect to the process 200 for motion stabilization of audio objects in the HOA domain. In some implementations, the stabilization unit 320 may calculate and apply separate instances of the effects matrix 240 to every audio sample, or frame, thereby compensating the audio objects of each sample to remediate movement-induced changes to the corresponding spatial information. However, in some implementations, such as the implementation illustrated in FIG. 4D, the stabilization unit 320 may conserve computing resources by deriving and applying separate instances of the effects matrix 240 to a sample at a given interval, e.g., every 10 samples, every 12, or so on. The interval of samples determined by the stabilization unit 320 is referred to as a "block" of samples herein.

FIG. 4D illustrates four such blocks, namely, the audio sample blocks 250A-250D. To mitigate or possibly remove blocking artifacts caused by applying the effects matrix at such intervals, the audio encoding device may apply techniques of this disclosure to interpolate the separate instances of the effects matrix 240. In other words, the stabilization unit 320 may "smooth out" the transitions within each of the audio sample blocks 250A-250D by applying the corresponding interpolation functions 260A-260D to the previous instance of the effects matrix 240.

By applying the interpolation functions 260A-260D to the corresponding instance of the effects matrix 240, the stabilization unit 320 may apply techniques of this disclosure to mitigate precision loss, while improving coding efficiency. More specifically, the stabilization unit 320 may exploit the sparseness of the effects matrix 240 (e.g., in terms of significant weight values as opposed to the more common zero entries) to apply the effects matrix 240 at multi-sample intervals, and interpolating the effects matrix 240 through the intervals. The interpolation-based implementation of FIG. 4D may represent a more efficient and computationally less-taxing solution than real-time computation and application of the effects matrix 240 for each sample of the transcoded audio input.

As illustrated in FIG. 4D, the post-transcoding motion compensation techniques described with respect to FIGS. 4A-4D are customizable. Other customizations that are possible with respect to the post-transcoding motion compensation techniques include applying the motion compensation to target only select segments of captured audio data, setting thresholds to determine whether a movement qualifies as a micromovement to be compensated, and so on. Thus, the post-transcoding motion compensation solution of FIGS. 4A-4D represent a customizable solution that the audio encoding device 20 may implement to compensate micromovements, based on device characteristics, sound characteristics, user input or settings, or various other parameters that are specific to a particular scenario.

Figure 5:
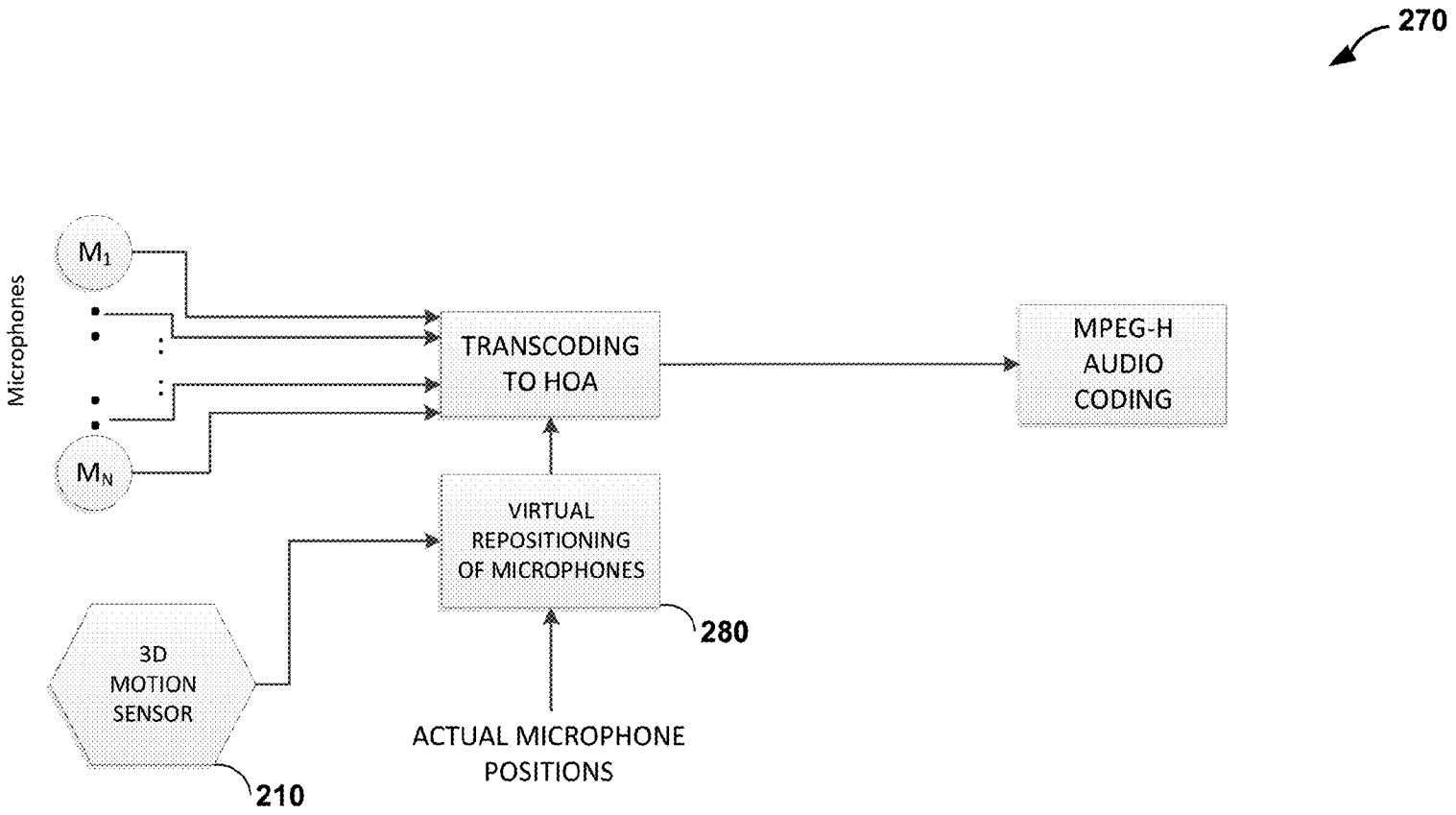
FIG. 5 is a flowchart illustrating exemplary operation of an audio decoding device in performing the coding techniques described in this disclosure.

FIG. 5 is a flowchart illustrating exemplary operation of an audio decoding device in performing the coding techniques described in this disclosure. FIG. 5 illustrates an example process 270 by which the virtual repositioning unit 330 (and/or one or more components thereof, functioning either individually or in any combination) may stabilize audio objects of a soundfield by implementing motion compensation, in accordance with various aspects of this disclosure. In the implementation of FIG. 5, the virtual repositioning unit 330 may perform the motion compensation operation(s) on audio data at a pre-transcoding stage, i.e. audio data that is not in the HOA domain.

As shown in FIG. 5, the virtual repositioning unit 330 may perform a virtual repositioning of one or more of the individual microphones $M_1$ through $M_n$ (280) to compensate movements. More specifically, the inputs to the step 280 include motion information of the microphone array, as determined from a 3D motion sensor (e.g., accelerometer) at the step 210, and the actual positions of the individual microphones $M_1$ through $M_n$. In turn, the virtual repositioning unit 330 may combine the motion information received at the step 210 with the actual microphone positions to derive the virtual repositioning information at the step 280. The audio encoding device may apply the virtual repositioning at the step 280 to adjust the spatial information for audio objects captured by the individual microphones $M_1$ through $M_n$, and propagate the virtual repositioning for future audio captures.

The process 270 illustrated in FIG. 5 represents a low-complexity, and thus, computationally less expensive implementation as compared to the post-transcoding compensation techniques described with respect to FIGS. 4A-4D. By implementing the virtual microphone repositioning "on the fly" as in the process 270, and propagating forward any motion compensation adjustments for future audio captures, the virtual repositioning unit 330 may mitigate or potentially eliminate the effects of microphone jitter, while conserving computing resources and energy consumption. Thus, the process 270 may illustrate a motion compensation process that is viable for low-battery scenarios, as well as scenarios in which the audio encoding device has relatively less computing resources available (e.g., via a smartphone or a tablet computer).

The conversion (or transcoding) from the microphone signals $x_L$ of a spherical microphone array into the HOA domain may be performed via a discrete spherical transform DSHT in combination with subsequent signal processing based on geometric properties of the array. The DSHT may be carried out by multiplication of the microphone signals $x_N$ with the spherical harmonics up to the HOA order N computed for the directions of the microphones $\Gamma=[\gamma_1, \ldots \gamma_L]^T$ as follows:

$$\mathrm{DSHT}_N = Y_N^{-1}(\Gamma)\cdot x_L$$

The expected rotation of the soundfield is performed by virtually rotating the direction of the microphones using the rotation kernel $R(\phi, \theta, \psi)$ as follows:

$$\mathrm{DSHT}_N = Y_N^{-1}(R(\phi,\theta,\psi)\cdot\Gamma)\cdot x_L$$

Figures 6A, 6B, 6C, 6D, 6E:
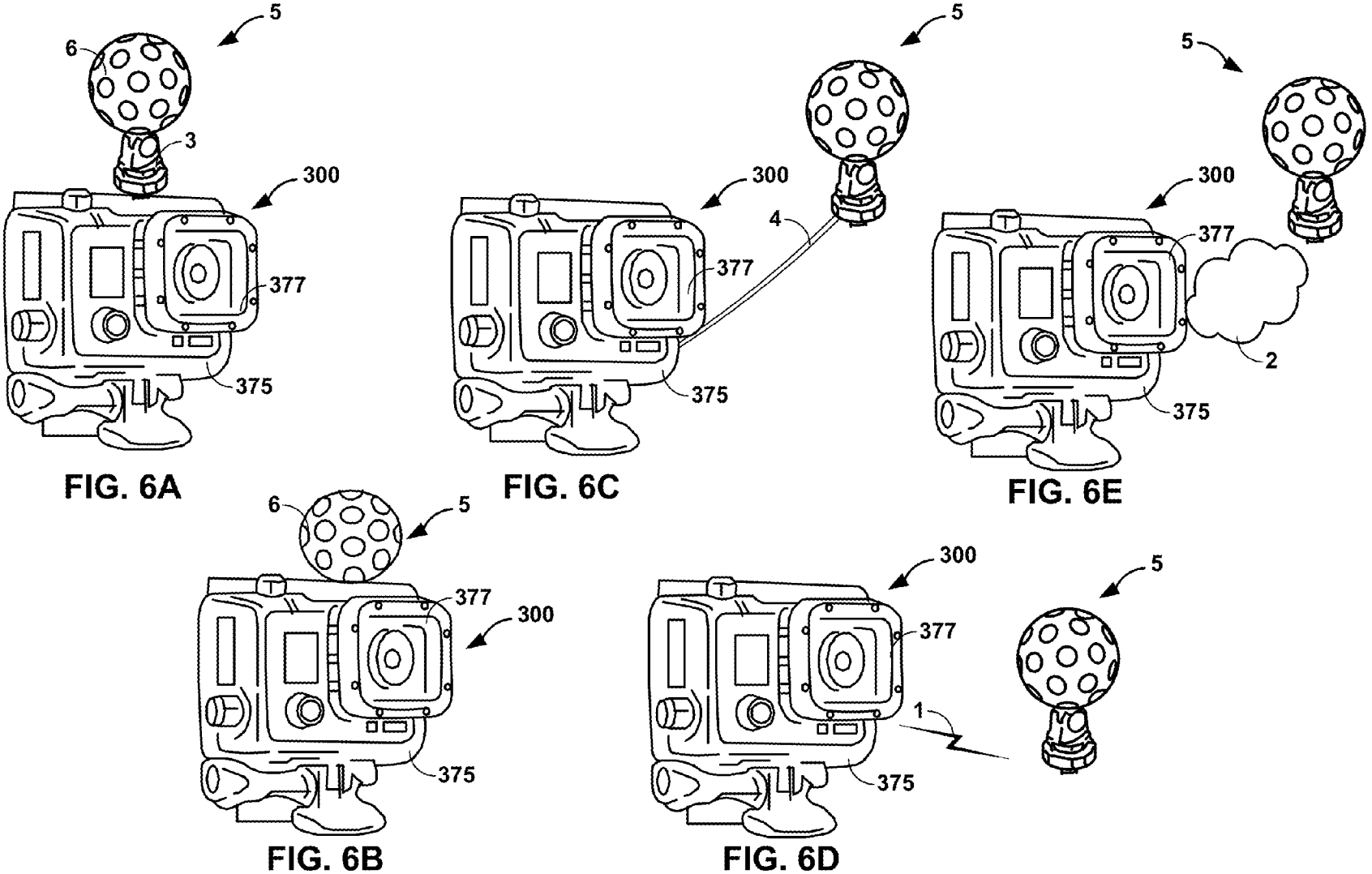
FIGS. 6A-6F are diagrams illustrating different combinations of a content capture device 300 and a microphone, in accordance with various aspects of this disclosure.

FIGS. 6A-6F are diagrams illustrating different combinations of the content capture device 300 and the microphone 5. In the example of FIG. 6A, the content capture device 300 (shown as a ruggedized camera for purposes of illustrations) may represent a camera system having a housing 375 in which an image capture system 377, including a lens, is configured to capture one or both of video data and image data. The housing 375 may be adapted to integrate the entire microphone 5, including a stand 3 of the microphone 5. In other words, the microphone 5 includes the stand 3 and a microphone array 6. The stand 3 may be affixed to the housing 375 and the microphone array 6.

In the example of FIG. 6B, the microphone 5 does not include the stand 3, but is still integrated with the content capture device 300. In other words, the microphone 5 only includes the microphone array 6, which is affixed to the housing 375. In the example of FIG. 6C, the microphone 5 communicates with the content capture device 300 via a wire 4. A processor (not shown) may be configured to obtain the HOA coefficients 11 via the wire 4. In the examples of FIGS. 6D and 6E, the microphone 5 is in wireless communication with the content capture device 300 via a PAN 1 and a WLAN 2 respectively. The processor may be configured, in the examples of FIGS. 6D and 6E, to obtain the HOA coefficients 11 wirelessly (e.g., via the PAN 1 and the WLAN 2 respectively).

Figure 6F:
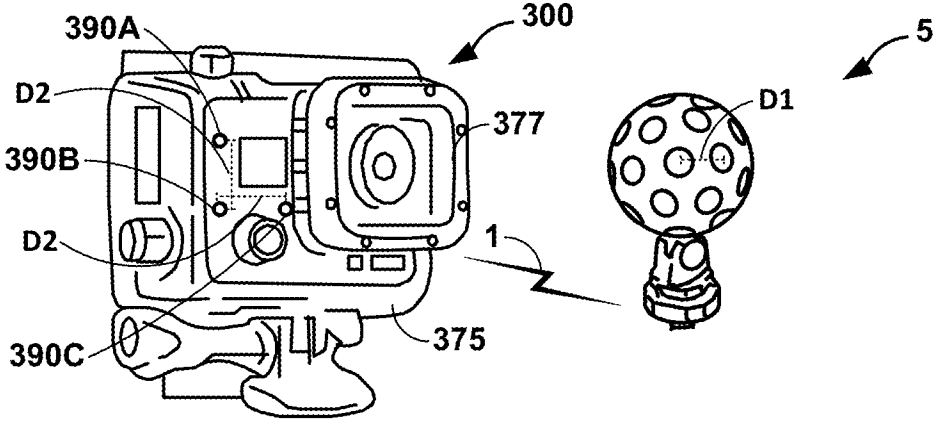

In the example of FIG. 6F, the content capture device 300 also includes integrated microphones 390A-390C. The 3D audio microphone 5 includes a microphone array, wherein each microphone of the microphone array is approximately a distance D1 from an adjacent microphone. Each microphone of the microphone array is also positioned equidistantly around a semi-sphere or, alternative, around a sphere. The integrated microphones of 390A-390C may be positioned a distance D2 from an adjacent microphone. The distance D2 may be larger than the distance D1. The content capture device 300 may include the integrated microphones 390A-390C to augment the HOA audio data captured by the microphone 5. The larger microphone separate (as represented by distance D2) of the integrated microphones 390A-390C may facilitate capture of lower frequencies. Because the distance D1 of the microphones of the microphone array is small, the microphone 5 may not be able to adequately capture lower frequencies.

Figure 7C:
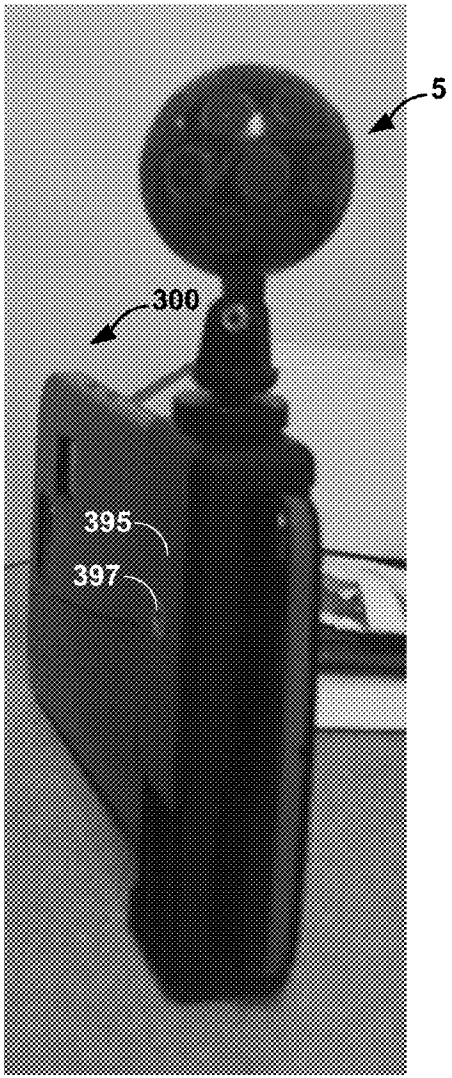
FIGS. 7A-7E are diagrams illustrating different examples of a content capture device in the form of a smart phone that utilize a three-dimensional microphone secured to the content capture device in accordance with the techniques described in this disclosure.
Figure 7B:
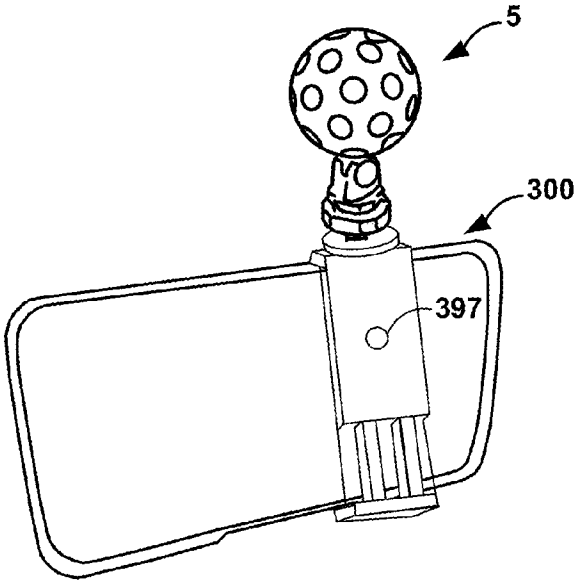
Figure 7A:
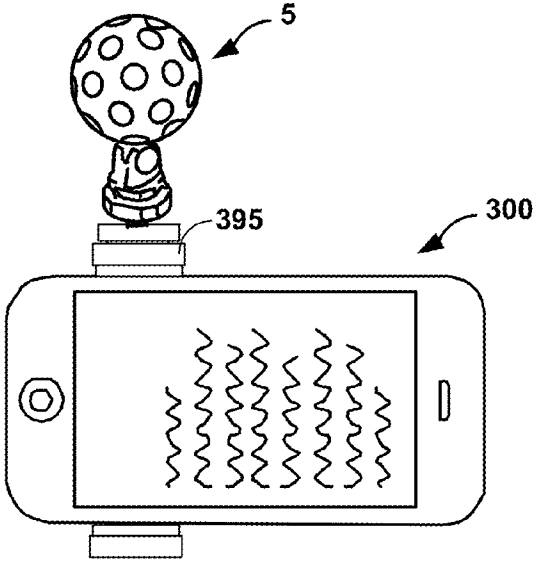
Figure 7D:
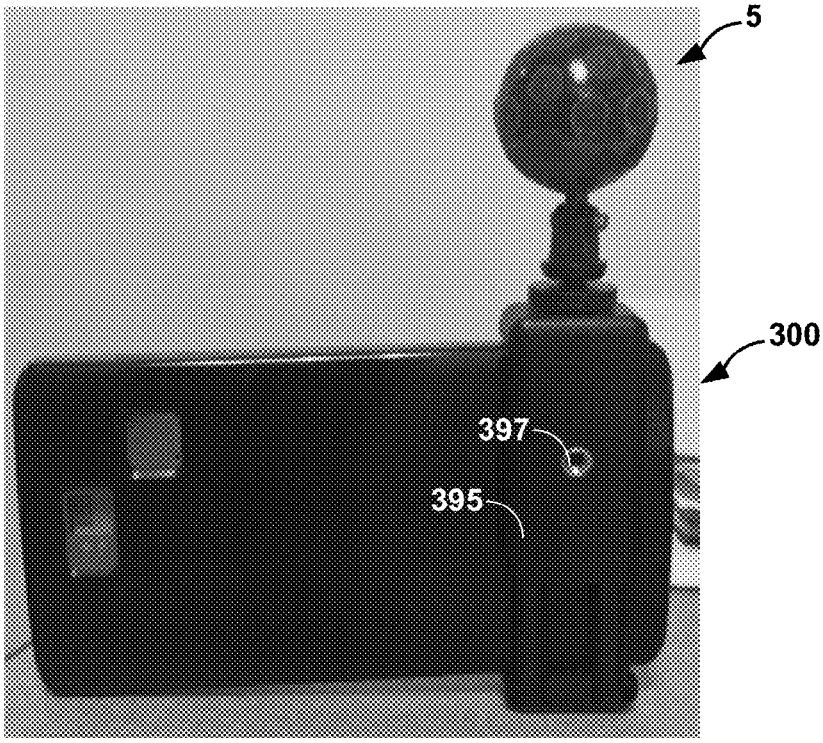
Figure 7E:
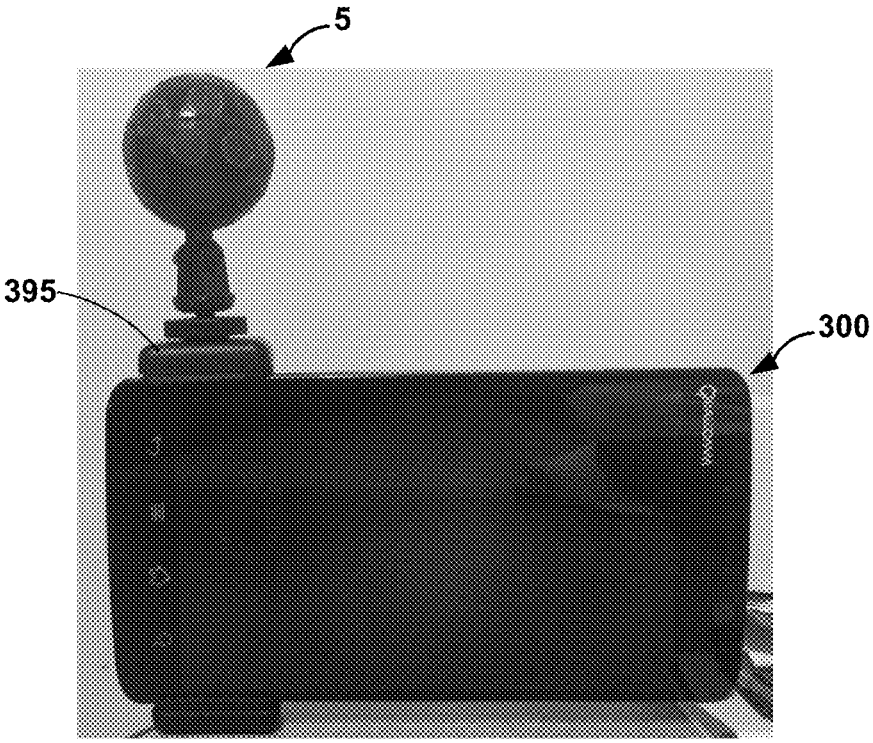

FIGS. 7A-7E are diagrams illustrating different examples of a content capture device in the form of a smart phone that utilize a three-dimensional microphone secured to the content capture device in accordance with the techniques described in this disclosure. In the example of FIG. 7A, the content capture device 300 provides a platform to which a securing device 395 is affixed. The securing device 395 may include a clamp. The clamp may ratchet down via a tension ratcheting mechanism so as to accommodate different sizes and form factors of a potential content capture device 300 used with the microphone 5. The securing device 395 may include a number of microphone attachment points. The microphone attachment points may comprise female screw attachment points that accept common screw size and threading for cameras or other types of audio/visual equipment. The microphone attachment points may be located on the top of the clamp (where the top refers to the top of the clamp when used while the content capture device 300 is in held in a landscape orientation). The microphone attachment points may also be located on the rear of the clamp as shown in FIG. 7B by a microphone attachment point 397. The examples of FIGS. 7C-7E provide further side, back and front snapshots of the securing device 395.

Figure 8A:
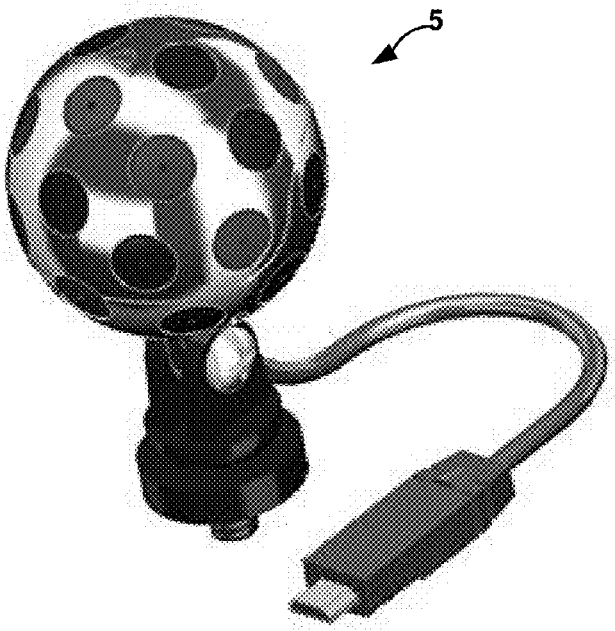
FIGS. 8A and 8B are diagrams illustrating different examples of a microphone, in accordance with one or more aspects of this disclosure.
Figure 8B:
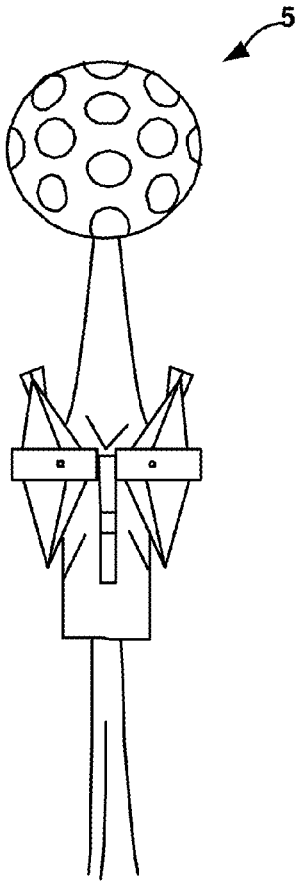

FIGS. 8A and 8B are diagrams illustrating different examples of the microphone 5. In the example of FIG. 8A, a 32 microphone array microphone developed by Qualcomm Technologies Inc. is shown. The microphone 5 of FIG. 8A includes, as one example, a USB wired connection. The example shown in FIG. 8B, is an alternative microphone to the Qualcomm 32 microphone device, which is referred to as an Eigenmike™.

Figure 9:
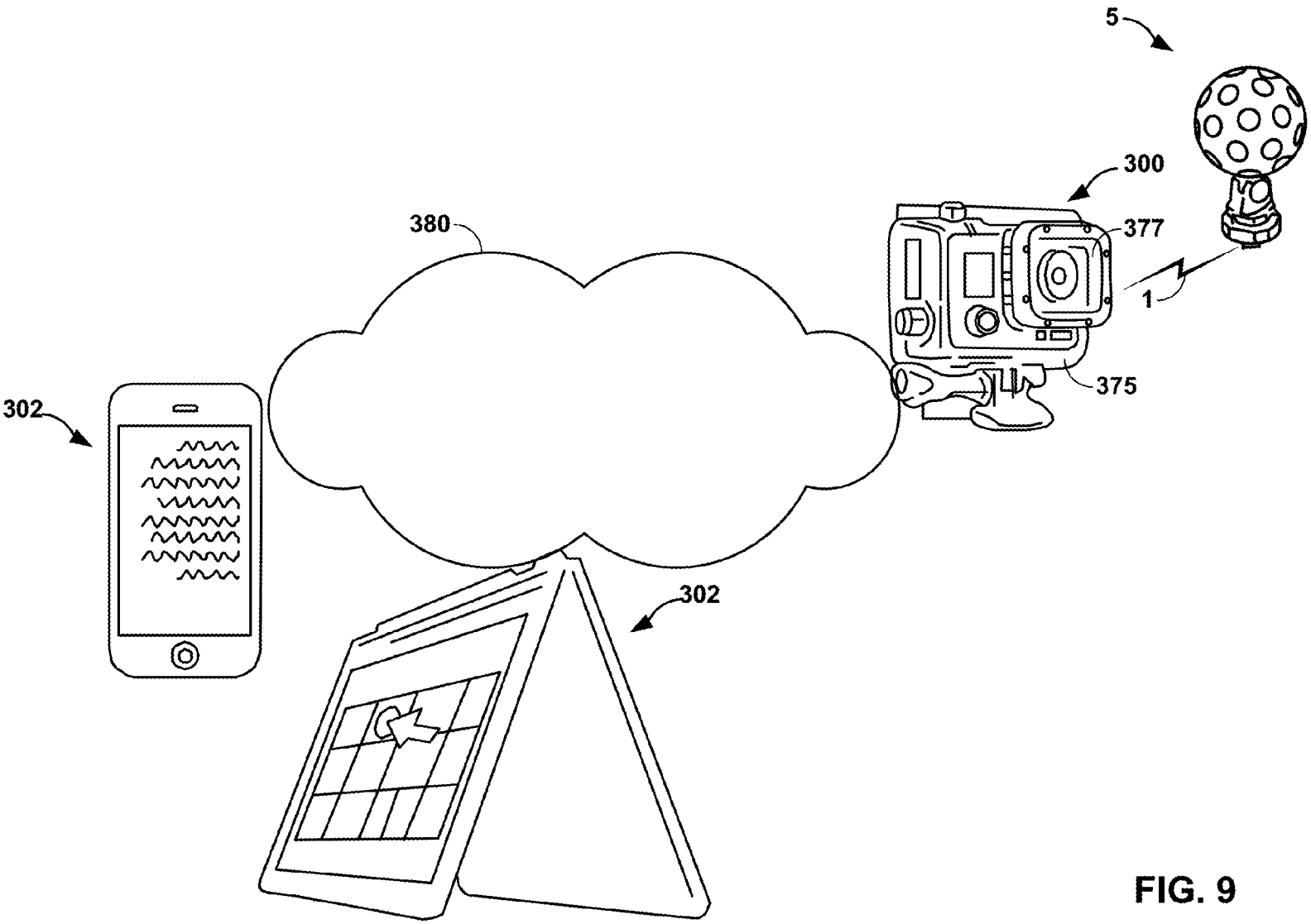
FIG. 9 is a conceptual diagram illustrating an example content capture device in communication with one or more example content capture assistant devices, in accordance with one or more aspects of this disclosure.

FIG. 9 is a conceptual diagram illustrating an example content capture device 300 in communication with one or more example content capture assistant devices 302. As shown in the example of FIG. 9, the content capture assistant devices 302 (which are shown as a smart phone and tablet/laptop for purposes of illustration) may communicate with the content capture device 300 via a wireless local area network 380. Alternatively, the content capture assistant devices 302 may communicate with the content capture device 300 via a personal area network, a cellular network or other wireless forms of communication. Moreover, the content capture assistant devices 302 may communicate with the content capture device 300 via a wired connection. Although shown as communicating with the microphone 5 via a personal area network 1, the content capture device 300 may communicate with the microphone 5 via any form of communication, such as those described above with respect to the examples of FIGS. 4A-4D.

As shown, in some examples, this disclosure is directed to a method of motion compensation, the method including adjusting one or more higher-order ambisonics (HOA) representations of a three-dimensional (3D) soundfield to compensate one or more movements associated with a capture of one or more audio objects of the 3D soundfield. In some examples, adjusting the one or more HOA representations includes obtaining an effects matrix associated with the one or more movements. In some examples, the effects matrix represents an inverse rotation operation with respect to the one or more movements.

In some examples, adjusting the one or more HOA representations includes applying the effects matrix to the one or more HOA representations to obtain a motion compensated 3D soundfield. According to some examples, obtaining the effects matrix includes obtaining rotational information associated with the one or more movements and calculating the effects matrix at least in part by calculating an inverse of the rotational information. In some examples, the effects matrix comprises a set of zero entries and a set of significant entries. According to one such example, the set of zero entries includes a greater number of entries than the set of significant entries.

According to some examples, adjusting the one or more HOA representations comprises adjusting the one or more HOA representations for each audio sample of audio data. In some examples, adjusting the one or more HOA representations comprises adjusting the one or more HOA representations for a subset of the audio samples, such that any pair of audio samples of the subset represents an interval of the plurality of the audio samples. According to some examples, the interval comprises one of a ten-sample interval or a twelve-sample interval. In some examples, the method may further include interpolating the effects matrix with respect to each interval, to obtain one or more interpolated effects matrices. In one such example, the method may further include applying each interpolated effects matrix to a corresponding sample included in a corresponding interval.

In some examples, the method may further include obtaining data describing the movements from a motion sensing device. In some examples, the motion sensing device comprises one or more of an accelerometer or a compass. According to some examples, the motion sensor is coupled to a microphone array that is configured to capture the audio data. In some examples, the motion sensing device forms a part of the microphone array. According to some examples, the method may further include differentiating one or more micromovements from one or more gradual movements associated with the one or more audio objects of the 3D soundfield. In one such example, differentiating the micromovements from the gradual movements is based on a threshold value associated with one or more of a distance, a frequency, or an angle sharpness describing motion information associated with the capture.

According to some examples, the method may further include obtaining one or more of a yaw angle, a pitch angle, or a roll angle associated with the movements. In some examples, adjusting the one or more HOA representations includes altering spatial information associated with the one or more HOA representations. In some examples in accordance with aspects of this disclosure, a device is configured to compensate motion, and the device may include a memory configured to store higher-order ambisonic (HOA) audio data, and one or more processors configured to perform any of the methods described above, or any combination of the described methods. In some examples, a device is configured to compensate motion, and the device may include means for storing higher-order ambisonic (HOA) audio data, and means for performing any of the methods described above, or any combination of the described methods. In some examples, a computer-readable storage medium may be encoded with instructions that, when executed, perform any of the methods described above, or any combination of the described methods.

According to some aspects, this disclosure is directed to a method of motion compensation. The method may include adjusting virtual positioning information associated with one or more microphones of a microphone array to compensate one or more movements associated with a capture of one or more audio objects of a three-dimensional (3D) soundfield by the microphone array. In some examples, the method includes adjusting the virtual positioning information comprises adjusting the virtual positioning information for a time-domain representation of the 3D soundfield. In some examples, the time-domain representation of the 3D soundfield comprises a pre-transcoding representation of the 3D soundfield. In some examples, the method may further include adjusting the virtual positioning information for all audio samples captured by the microphone array with respect to the 3D soundfield.

In some examples, adjusting the virtual positioning information comprises generating virtual re-positioning information based on the movements and actual positioning information associated with the microphone array. In some such examples, the method further includes obtaining data describing the movements from a motion sensing device. In one such example, the motion sensing device comprises one or more of an accelerometer or a compass.

In some examples in accordance with aspects of this disclosure, a device is configured to compensate motion, and the device may include a memory configured to store higher-order ambisonic (HOA) audio data, and one or more processors configured to perform any of the methods described above, or any combination of the described methods. In some examples, a device is configured to compensate motion, and the device may include means for storing higher-order ambisonic (HOA) audio data, and means for performing any of the methods described above, or any combination of the described methods. In some examples, a computer-readable storage medium may be encoded with instructions that, when executed, perform any of the methods described above, or any combination of the described methods.

According to some aspects, this disclosure is directed to a camera system that includes a housing, an image capture system, including a lens, to capture one or both of video data and image data, and a three-dimensional (3D) microphone configured to capture higher-order ambisonic audio data, wherein the 3D microphone including a stand and a microphone array, and wherein the stand is affixed to the housing of the camera and the microphone array. In some examples, the housing is configured to receive one or more motion sensing devices. According to one such example, the 3D microphone is configured to be coupled to one or more motion sensing devices.

In some examples, the one or more motion sensing devices comprise at least one of an accelerometer or a compass. According to one such example, the accelerometer is configured to obtain motion information associated with the 3D microphone. In some examples, the compass is configured obtain motion information associated with the 3D microphone that includes information associated with one or more cardinal directions.

According to some aspects, this disclosure is directed to a camera system that includes a housing, an image capture system, including a lens, to capture one or both of video data and image data, and a three-dimensional (3D) microphone configured to capture higher-order ambisonic audio data, wherein the 3D microphone includes a microphone array affixed to the housing of the camera. In some examples, the housing is configured to receive one or more motion sensing devices. In some examples, the 3D microphone is configured to be coupled to one or more motion sensing devices. In some examples, the one or more motion sensing devices comprise at least one of an accelerometer or a compass. According to one such example, the accelerometer is configured to obtain motion information associated with the 3D microphone. According to some examples, the compass is configured obtain motion information associated with the 3D microphone that includes information associated with one or more cardinal directions.

According to some aspects, this disclosure is directed to a camera system that includes a processor, an image capture system, including a lens, to capture one or both of video data and image data, and a three-dimensional (3D) microphone configured to capture higher-order ambisonic audio data, where the 3D microphone includes a wire communicatively coupling the 3D microphone to the processor, and where the processor is configured to obtain the higher-order ambisonic audio data via the wire. In some examples, the housing is configured to receive one or more motion sensing devices. In some examples, the 3D microphone is configured to be coupled to one or more motion sensing devices. According to some examples, the one or more motion sensing devices comprise at least one of an accelerometer or a compass. In one such example, the accelerometer is configured to obtain motion information associated with the 3D microphone. According to some examples, the compass is configured obtain motion information associated with the 3D microphone that includes information associated with one or more cardinal directions.

In some aspects, this disclosure is directed to a method of motion compensation. The method comprises receiving, by a device configured to compensate motion, motion information indicating one or more movements associated with a capture of one or more audio objects of a three-dimensional (3D) soundfield by a microphone array. The method further includes adjusting, by the device configured to compensate motion, virtual positioning information associated with one or more microphones of a microphone array to compensate the one or more movements associated with the capture of the one or more audio objects of the 3D soundfield by the microphone array. The method may further include generating, by the device configured to compensate motion, a motion-compensated bitstream based on the adjusted virtual positioning information. In some examples, adjusting the virtual positioning information comprises adjusting, by the device configured to compensate motion, one or more higher-order ambisonics (HOA) representations of the 3D soundfield. In some examples, adjusting the one or more HOA representations comprises altering, by the device configured to compensate motion, spatial information associated with the one or more HOA representations. In some examples, adjusting the one or more HOA representations comprises obtaining, by the device configured to compensate motion, an effects matrix associated with the one or more movements.

According to some examples, the effects matrix represents an inverse rotation operation with respect to the one or more movements. In some instances, adjusting the one or more HOA representations comprises applying, by the device configured to compensate motion, the effects matrix to the one or more HOA representations to obtain a motion compensated 3D soundfield. In some examples, obtaining the effects matrix comprises obtaining, by the device configured to compensate motion, rotational information associated with the one or more movements, and calculating, by the device configured to compensate motion, the effects matrix at least in part by calculating an inverse of the rotational information.

In some examples, the effects matrix comprises a set of zero entries and a set of significant entries, and the set of zero entries includes a greater number of entries than the set of significant entries. In some instances, adjusting the one or more HOA representations comprises adjusting, by the device configured to compensate motion, the one or more HOA representations for a subset of a plurality of audio samples associated with the 3D soundfield, such that any pair of audio samples of the subset represents an interval of the plurality of the audio samples.

According to some examples, the interval comprises one of a ten-sample interval or a twelve-sample interval. In some implementations, the method further comprises interpolating, by the device configured to compensate motion, the effects matrix with respect to each interval, to obtain one or more interpolated effects matrices. In one such example, the method further comprises applying, by the device configured to compensate motion, each interpolated effects matrix to a corresponding sample included in a corresponding interval.

In some implementations, the method further comprises differentiating, by the device configured to compensate motion, one or more micromovements from one or more gradual movements associated with the one or more audio objects of the 3D soundfield. In one such implementation, differentiating the micromovements from the gradual movements is based on a threshold value associated with one or more of a distance, a frequency, or an angle sharpness describing motion information associated with the capture.

In some examples, receiving the motion information indicating the one or more movements associated with the capture of the one or more audio objects of the 3D soundfield by the microphone array includes receiving, by the device configured to compensate motion, one or more of a yaw angle, a pitch angle, or a roll angle associated with the movements. In one such example, adjusting the virtual positioning information to compensate the movements comprises compensating, by the device configured to compensate motion, rotation information based on the obtained one or more of the yaw angle, the pitch angle, or the roll angle. According to some examples, adjusting the virtual positioning information comprises adjusting, by the device configured to compensate motion, the virtual positioning information for a time-domain representation of the 3D soundfield.

According to some examples, the time-domain representation of the 3D soundfield comprises a pre-transcoding representation of the 3D soundfield. In some examples, the method further includes adjusting, by the device configured to compensate motion, the virtual positioning information for all audio samples captured by the microphone array with respect to the 3D soundfield. In some examples, adjusting the virtual positioning information comprises generating, by the device configured to compensate motion, virtual re-positioning information based on the movements and actual positioning information associated with the microphone array.

In some aspects, this disclosure is directed to a device configured to compensate motion. The device comprises a memory configured to store audio data associated with a three-dimensional (3D) soundfield and one or more processors. The one or more processors are configured to receive motion information indicating one or more movements associated with a capture of one or more audio objects of a three-dimensional (3D) soundfield by a microphone array, and to adjust virtual positioning information associated with one or more microphones of a microphone array to compensate one or more movements associated with a capture of one or more audio objects of the 3D soundfield by the microphone array. The one or more processors may also be configured to generate a motion-compensated bitstream based on the adjusted virtual positioning information.

In some examples, the one or more processors are further configured to obtain data describing the movements from a motion sensing device. In some examples, the motion sensing device comprises one or more of an accelerometer or a compass. In some examples, to adjust the virtual positioning information, the one or more processors are configured to adjust one or more higher-order ambisonics (HOA) representations of the 3D soundfield. In some examples, to adjust the one or more HOA representations, the one or more processors are configured to obtain an effects matrix associated with the one or more movements. In one such example, the effects matrix represents an inverse rotation operation with respect to the one or more movements.

According to some examples, the one or more processors are configured to adjust the virtual positioning information by adjusting the virtual positioning information for a time-domain representation of the 3D soundfield. In some examples, the time-domain representation of the 3D soundfield comprises a pre-transcoding representation of the 3D soundfield. According to some examples, the one or more processors are configured to adjust the virtual positioning information by generating virtual re-positioning information based on the movements and actual positioning information associated with the microphone array.

In various aspects, this disclosure is directed to a device configured to compensate motion. The device comprises means for storing audio data associated with a three-dimensional (3D) soundfield, means for receiving motion information indicating one or more movements associated with a capture of one or more audio objects of the 3D soundfield by a microphone array, and means for adjusting virtual positioning information associated with one or more microphones of a microphone array to compensate the one or more movements associated with the capture of the one or more audio objects of the 3D soundfield by the microphone array. The device may also include means for generating a motion-compensated bitstream based on the adjusted virtual positioning information. According to some implementations, the means for adjusting the virtual positioning information include means for adjusting one or more higher-order ambisonics (HOA) representations of the 3D soundfield. In some examples, wherein the means for adjusting the virtual positioning information include: means for obtaining rotational information associated with the one or more movements, means for calculating an inverse of the rotational information to obtain an effects matrix representing an inverse operation with respect to the rotational information, and means for applying the effects matrix to the one or more HOA representations to obtain a motion compensated 3D soundfield. According to some examples, the means for adjusting the virtual positioning information comprise means for adjusting the virtual positioning information for a time-domain representation of the 3D soundfield, the time-domain representation of the 3D soundfield comprising a pre-transcoding representation of the 3D soundfield.

In some aspects, this disclosure is directed to a non-transitory computer-readable storage medium encoded with instructions. The instructions, when executed, cause one or more processors of a computing device for compensating motion to receive motion information indicating one or more movements associated with a capture of one or more audio objects of the 3D soundfield by a microphone array, to adjust virtual positioning information associated with one or more microphones of a microphone array to compensate the one or more movements associated with the capture of one or more audio objects of the 3D soundfield by the microphone array, and to generate a motion-compensated bitstream based on the adjusted virtual positioning information.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

What is claimed is:

1. A method of motion compensation, the method comprising:

receiving, by a device configured to compensate motion, motion information indicating one or more movements associated with a capture of one or more audio objects of a three-dimensional (3D) soundfield by a microphone array;

adjusting, by the device configured to compensate motion, one or more higher-order ambisonics (HOA) representations of the 3D soundfield to compensate the one or more movements associated with the capture of one or more audio objects of the 3D soundfield by the microphone array; and generating, by the device configured to compensate motion, a motion-compensated bitstream based on the HOA representations of the 3D soundfield.

2. The method of claim 1, wherein adjusting the one or more HOA representations of the 3D soundfield comprises adjusting, by the device configured to compensate motion, virtual positioning information associated with one or more microphones of the microphone array.

3. The method of claim 1, wherein adjusting the one or more HOA representations comprises altering, by the device configured to compensate motion, spatial information associated with the one or more HOA representations.

4. The method of claim 1, wherein adjusting the one or more HOA representations comprises obtaining, by the device configured to compensate motion, an effects matrix associated with the one or more movements.

5. The method of claim 4, wherein the effects matrix represents an inverse rotation operation with respect to the one or more movements.

6. The method of claim 4, wherein adjusting the one or more HOA representations comprises applying, by the device configured to compensate motion, the effects matrix to the one or more HOA representations to obtain a motion compensated 3D soundfield.

7. The method of claim 4, wherein obtaining the effects matrix comprises:

obtaining, by the device configured to compensate motion, rotational information associated with the one or more movements; and calculating, by the device configured to compensate motion, the effects matrix at least in part by calculating an inverse of the rotational information.

8. The method of claim 4, wherein the effects matrix comprises a set of zero entries and a set of significant entries, and wherein the set of zero entries includes a greater number of entries than the set of significant entries.

9. The method of claim 1, wherein adjusting the one or more HOA representations comprises adjusting, by the device configured to compensate motion, the one or more HOA representations for a subset of a plurality of audio samples associated with the 3D soundfield, such that any pair of audio samples of the subset represents an interval of the plurality of the audio samples.

10. The method of claim 9, wherein the interval comprises one of a ten-sample interval or a twelve-sample interval.

11. The method of claim 9, further comprising interpolating, by the device configured to compensate motion, a respective effects matrix with respect to each interval, to obtain one or more interpolated effects matrices.

12. The method of claim 11, further comprising applying, by the device configured to compensate motion, each interpolated effects matrix to a corresponding sample included in a corresponding interval.

13. The method of claim 1, further comprising differentiating, by the device configured to compensate motion, one or more micromovements from one or more gradual movements associated with the one or more audio objects of the 3D soundfield.

14. The method of claim 13, wherein differentiating the micromovements from the gradual movements is based on a threshold value associated with one or more of a distance, a frequency, or an angle sharpness describing motion information associated with the capture.

15. The method of claim 1, wherein receiving the motion information indicating the one or more movements associated with the capture of the one or more audio objects of the 3D soundfield by the microphone array comprises receiving, by the device configured to compensate motion, one or more of a yaw angle, a pitch angle, or a roll angle associated with the movements, and wherein adjusting the one or more HOA representations of the 3D soundfield to compensate the movements comprises compensating, by the device configured to compensate motion, rotation information based on the received one or more of the yaw angle, the pitch angle, or the roll angle.

16. The method of claim 1, wherein adjusting the one or more HOA representations of the 3D soundfield comprises adjusting, by the device configured to compensate motion, the one or more HOA representations of the 3D soundfield for a time-domain representation of the 3D soundfield.

17. The method of claim 16, wherein the time-domain representation of the 3D soundfield comprises a pre-transcoding representation of the 3D soundfield.

18. The method of claim 1, further comprising adjusting, by the device configured to compensate motion, the one or more HOA representations for all audio samples captured by the microphone array with respect to the 3D soundfield.

19. The method of claim 1, wherein adjusting the one or more HOA representations of the 3D soundfield comprises generating, by the device configured to compensate motion, virtual re-positioning information based on the movements and actual positioning information associated with the microphone array.

20. A device configured to compensate motion, the device comprising:

a memory configured to store audio data associated with a three-dimensional (3D) soundfield; and one or more processors coupled to the memory, the one or more processors being configured to:

receive motion information indicating one or more movements associated with a capture of one or more audio objects of the three-dimensional (3D) soundfield by a microphone array;

adjust one or more higher-order ambisonics (HOA) representations of the 3D soundfield associated with one or more microphones of a microphone array to compensate the one or more movements associated with the capture of one or more audio objects of the 3D soundfield by the microphone array; and generate a motion-compensated bitstream based on the adjusted HOA representations of the 3D soundfield.

21. The device of claim 20, wherein, to receive the motion information indicating the one or more movements associated with the capture of the one or more audio objects of the 3D soundfield by the microphone array, the one or more processors are configured to receive the motion information from a motion sensing device that comprises one or more of an accelerometer or a compass.

22. The device of claim 20, wherein, to adjust the one or more HOA representations of the 3D soundfield, the one or more processors are configured to adjust virtual positioning information soundfield associated with one or more microphones of the microphone array.

23. The device of claim 20, wherein, to adjust the one or more HOA representations, the one or more processors are configured to obtain an effects matrix that represents an inverse rotation operation with respect to the one or more movements.

24. The device of claim 20, wherein the one or more processors are configured to adjust the one or more HOA representations of the 3D soundfield by adjusting the one or more HOA representations of the 3D soundfield for a time-domain representation of the 3D soundfield, and wherein the time-domain representation of the 3D soundfield comprises a pre-transcoding representation of the 3D soundfield.

25. The device of claim 20, wherein the one or more processors are configured to adjust the one or more HOA representations of the 3D soundfield by generating virtual re-positioning information based on the movements and actual positioning information associated with the microphone array.

26. A device configured to compensate motion, the device comprising:

means for storing audio data associated with a three-dimensional (3D) soundfield;

means for receiving motion information indicating one or more movements associated with a capture of one or more audio objects of the 3D soundfield by a microphone array;

means for adjusting one or more higher-order ambisonics (HOA) representations of the 3D soundfield to compensate the one or more movements associated with the capture of one or more audio objects of the 3D soundfield by the microphone array; and means for generating a motion-compensated bitstream based on the adjusted HOA representations of the 3D soundfield.

27. The device of claim 26, wherein the means for adjusting the one or more HOA representations of the 3D soundfield comprise means for adjusting virtual positioning information associated with one or more microphones of the microphone array.

28. The device of claim 27, wherein the means for adjusting the one or more HOA representations of the 3D soundfield comprise:

means for obtaining rotational information associated with the one or more movements;

means for calculating an inverse of the rotational information to obtain an effects matrix representing an inverse operation with respect to the rotational information; and means for applying the effects matrix to the one or more HOA representations to obtain a motion compensated 3D soundfield.

29. The device of claim 26, wherein the means for adjusting the one or more HOA representations of the 3D soundfield comprise means for adjusting the one or more HOA representations of the 3D soundfield for a time-domain representation of the 3D soundfield, the time-domain representation of the 3D soundfield comprising a pre-transcoding representation of the 3D soundfield.

30. A non-transitory computer-readable storage medium encoded with instructions that, when executed, cause one or more processors of a computing device for compensating motion to:

receive motion information indicating one or more movements associated with a capture of one or more audio objects of the 3D soundfield by a microphone array;

adjust one or more higher-order ambisonics (HOA) representations of the 3D soundfield to compensate the one or more movements associated with the capture of one or more audio objects of the 3D soundfield by the microphone array; and generate a motion-compensated bitstream based on the adjusted HOA representations of the 3D soundfield.

* * * * *